US010042295B2

(12) United States Patent
Yoshinaga et al.

(10) Patent No.: US 10,042,295 B2
(45) Date of Patent: Aug. 7, 2018

(54) FIXING DEVICE, IMAGE FORMING APPARATUS, AND IMAGE FORMING METHOD

(71) Applicants: Hiroshi Yoshinaga, Chiba (JP); Kenji Ishii, Kanagawa (JP); Kazuhito Kishi, Kanagawa (JP); Takashi Seto, Kanagawa (JP); Takayuki Seki, Kanagawa (JP); Ippei Fujimoto, Kanagawa (JP); Misaki Shimizu, Tokyo (JP); Kazunari Sawada, Kanagawa (JP)

(72) Inventors: Hiroshi Yoshinaga, Chiba (JP); Kenji Ishii, Kanagawa (JP); Kazuhito Kishi, Kanagawa (JP); Takashi Seto, Kanagawa (JP); Takayuki Seki, Kanagawa (JP); Ippei Fujimoto, Kanagawa (JP); Misaki Shimizu, Tokyo (JP); Kazunari Sawada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/377,278

(22) Filed: Dec. 13, 2016

(65) Prior Publication Data

US 2017/0185015 A1 Jun. 29, 2017

(30) Foreign Application Priority Data

Dec. 25, 2015 (JP) ..... 2015-253440
Nov. 11, 2016 (JP) ..... 2016-220304

(51) Int. Cl.
*G03G 15/20* (2006.01)

(52) U.S. Cl.
CPC ..... *G03G 15/2039* (2013.01); *G03G 15/2053* (2013.01); *G03G 15/2082* (2013.01); *G03G 2215/2035* (2013.01)

(58) Field of Classification Search
CPC ..... G03G 15/2039; G03G 15/2042; G03G 15/2046; G03G 15/205; G03G 15/2053; G03G 15/2078; G03G 15/2082
See application file for complete search history.

(56) References Cited

U.S. PATENT DOCUMENTS 3,811,828 A * 5/1974 Ohta ..... G03G 15/2007 101/467
5,300,999 A * 4/1994 Koh ..... G03G 15/2064 219/469

(Continued)

FOREIGN PATENT DOCUMENTS

JP 2010-032631 2/2010
JP 2014-178370 9/2014

(Continued)

OTHER PUBLICATIONS

U.S. Appl. No. 15/178,079, filed Jun. 9, 2016.

*Primary Examiner* — Carla Therrien
(74) *Attorney, Agent, or Firm* — Oblon, McClelland, Maier & Neustadt, L.L.P.

(57) ABSTRACT

A fixing device includes an endless belt being applied with a lubricant on an inner circumferential surface of the endless belt. A pressure rotator presses against a nip formation pad via the endless belt to form a fixing nip between the endless belt and the pressure rotator. A radiant heater heats the endless belt. At least one contact heater heats at least one lateral end of the endless belt in an axial direction of the endless belt. At least one temperature detector detects a temperature of the endless belt. A controller controls the at least one contact heater to generate heat, controls the endless (Continued)

belt to rotate, and controls the radiant heater to generate heat sequentially based on the temperature of the endless belt that is detected by the at least one temperature detector.

16 Claims, 10 Drawing Sheets

(56) References Cited

U.S. PATENT DOCUMENTS 6,157,806 A * 12/2000 Elbert ..... G03G 15/2064 219/216
7,822,352 B2 * 10/2010 Coleman ..... G03G 15/2025 399/328
2004/0218943 A1 * 11/2004 Hirai ..... G03G 15/2039 399/69
2010/0290796 A1 * 11/2010 Sato ..... G03G 15/2039 399/33
2013/0028622 A1 * 1/2013 Nihonyanagi ..... G03G 15/2046 399/67
2015/0277311 A1 * 10/2015 Iwata ..... G03G 15/2042 399/329
2016/0161890 A1 6/2016 Shoji et al.
2016/0223961 A1 8/2016 Takagi et al.
2016/0223963 A1 8/2016 Yoshinaga et al.
2016/0274511 A1 9/2016 Ogino et al.
2016/0274514 A1 9/2016 Ishii et al.
2016/0334742 A1 11/2016 Kobashigawa et al.

FOREIGN PATENT DOCUMENTS

JP 2015-145950 8/2015
JP 2016-142985 8/2016

* cited by examiner

FIXING DEVICE, IMAGE FORMING APPARATUS, AND IMAGE FORMING METHOD

CROSS-REFERENCE TO RELATED APPLICATIONS

This patent application is based on and claims priority pursuant to 35 U.S.C. § 119 to Japanese Patent Application Nos. 2015-253440, filed on Dec. 25, 2015, and 2016-220304, filed on Nov. 11, 2016, in the Japanese Patent Office, the entire disclosure of each of which is hereby incorporated by reference herein.

BACKGROUND

Technical Field

Exemplary aspects of the present disclosure relate to a fixing device, an image forming apparatus, and an image forming method, and more particularly, to a fixing device for fixing a toner image on a recording medium, an image forming apparatus incorporating the fixing device, and an image forming method for forming a toner image on a recording medium.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt (e.g., an endless belt), and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes an endless belt that is flexible and rotatable. The endless belt is applied with a lubricant on an inner circumferential surface of the endless belt. A nip formation pad is disposed opposite the inner circumferential surface of the endless belt. A pressure rotator presses against the nip formation pad via the endless belt to form a fixing nip between the endless belt and the pressure rotator. A radiant heater, disposed opposite the inner circumferential surface of the endless belt, heats the endless belt. At least one contact heater, disposed at least at one lateral end of the nip formation pad in a longitudinal direction of the nip formation pad, heats at least one lateral end of the endless belt in an axial direction of the endless belt. At least one temperature detector, disposed opposite the endless belt, detects a temperature of the endless belt. A controller controls the at least one contact heater to generate heat, controls the endless belt to rotate, and controls the radiant heater to generate heat sequentially based on the temperature of the endless belt that is detected by the at least one temperature detector.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes an endless belt that is flexible and rotatable. The endless belt is applied with a lubricant on an inner circumferential surface of the endless belt. A nip formation pad is disposed opposite the inner circumferential surface of the endless belt. A pressure rotator presses against the nip formation pad via the endless belt to form a fixing nip between the endless belt and the pressure rotator. A radiant heater, disposed opposite the inner circumferential surface of the endless belt, heats the endless belt. At least one contact heater, disposed at least at one lateral end of the nip formation pad in a longitudinal direction of the nip formation pad, heats at least one lateral end of the endless belt in an axial direction of the endless belt. At least one temperature detector, disposed opposite the endless belt, detects a temperature of the endless belt. A controller controls the at least one contact heater to generate heat, controls the endless belt to rotate, and controls the radiant heater to generate heat sequentially based on the temperature of the endless belt that is detected by the at least one temperature detector.

This specification further describes an improved image forming method. In one exemplary embodiment, the image forming method includes determining that a temperature of an endless belt is higher than a predetermined first temperature and not higher than a predetermined second temperature; supplying power to a contact heater to heat the endless belt; rotating the endless belt; and supplying power to a radiant heater to heat the endless belt.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
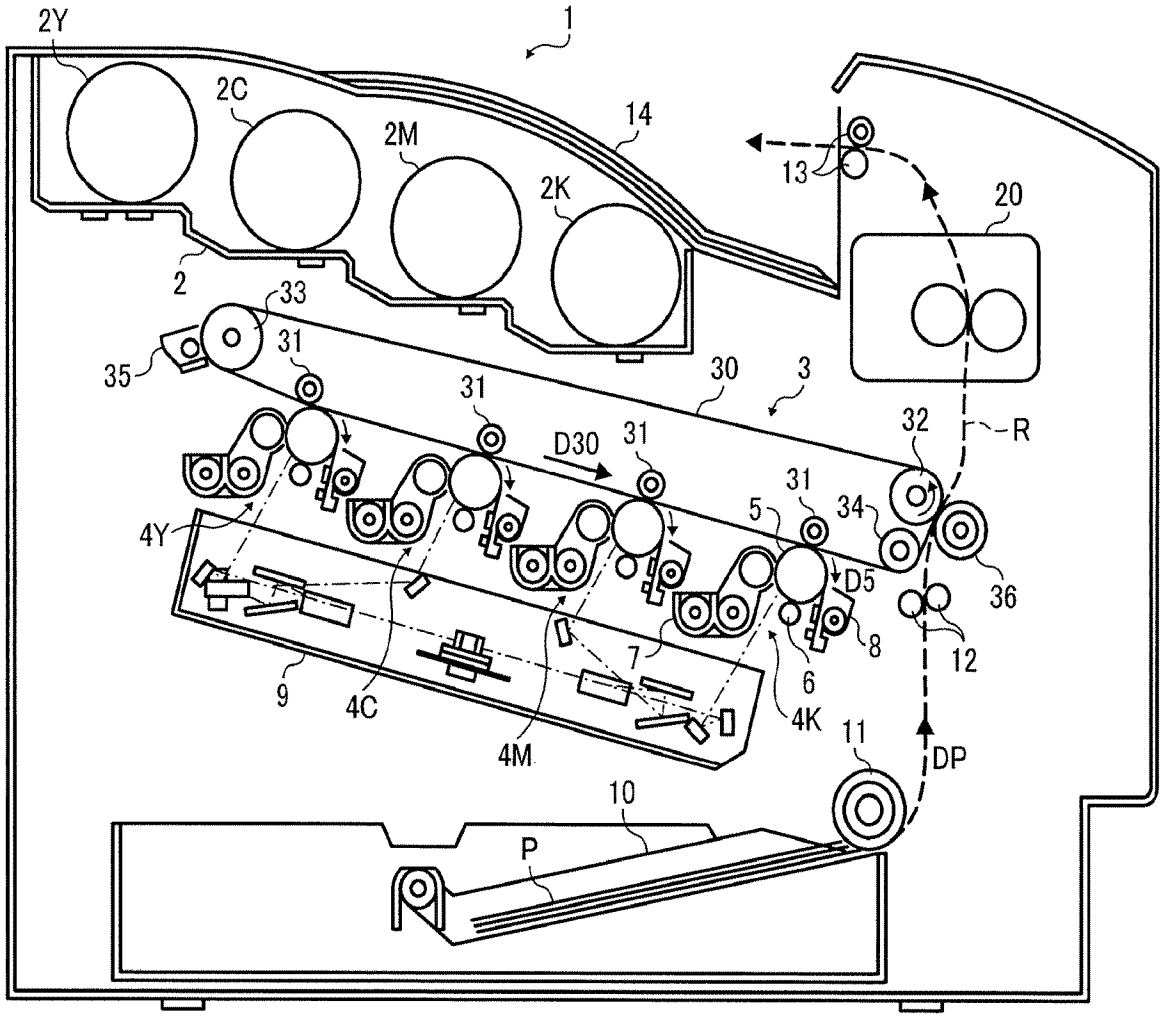
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

As illustrated in FIG. 1, the image forming apparatus 1 is a color laser printer including four image forming devices 4Y, 4C, 4M, and 4K situated in a center portion of the image forming apparatus 1. The image forming devices 4Y, 4C, 4M, and 4K are aligned in a stretch direction in which an intermediate transfer belt 30 is stretched. Although the image forming devices 4Y, 4C, 4M, and 4K contain developers in different colors, that is, yellow, cyan, magenta, and black corresponding to color separation components of a color image (e.g., yellow, cyan, magenta, and black toners), respectively, the image forming devices 4Y, 4C, 4M, and 4K have an identical structure.

For example, each of the image forming devices 4Y, 4C, 4M, and 4K, serving as an image forming station, includes a drum-shaped photoconductor 5 serving as a latent image bearer or an image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4C, and 4M that form yellow, cyan, and magenta toner images, respectively, are omitted.

Below the image forming devices 4Y, 4C, 4M, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4C, 4M, and 4K is a transfer device 3. For example, the transfer device 3 includes the intermediate transfer belt 30 serving as a transferred image bearer, four primary transfer rollers 31 serving as primary transferors, and a secondary transfer roller 36 serving as a secondary transferor. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply disposed inside the image forming apparatus 1. The power supply applies at least one of a predetermined direct current (DC) voltage and a predetermined alternating current (AC) voltage to each of the primary transfer rollers 31.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply disposed inside the image forming apparatus 1. The power supply applies at least one of a predetermined direct current (DC) voltage and a predetermined alternating current (AC) voltage to the secondary transfer roller 36.

The belt cleaner 35 includes a cleaning brush and a cleaning blade that contact an outer circumferential surface of the intermediate transfer belt 30.

A bottle holder 2 situated in an upper portion of the image forming apparatus 1 accommodates four toner bottles 2Y, 2C, 2M, and 2K detachably attached to the bottle holder 2. The toner bottles 2Y, 2C, 2M, and 2K contain fresh yellow, cyan, magenta, and black toners to be supplied to the developing devices 7 of the image forming devices 4Y, 4C, 4M, and 4K, respectively. For example, the fresh yellow, cyan, magenta, and black toners are supplied from the toner bottles 2Y, 2C, 2M, and 2K to the developing devices 7 through toner supply tubes interposed between the toner bottles 2Y, 2C, 2M, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a conveyor conveys the sheet P conveyed from the feed roller 11 toward the secondary transfer nip.

The conveyance path R is further provided with a fixing device 20 located above the secondary transfer nip, that is, downstream from the secondary transfer nip in the sheet conveyance direction DP. The fixing device 20 fixes an unfixed toner image, which is transferred from the intermediate transfer belt 30 onto the sheet P, on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4C, 4M, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, cyan, magenta, and black image data constructing color image data sent from the external device, respectively, thus forming electrostatic latent images on the photoconductors 5. The image data used to expose the respective photoconductors 5 is monochrome image data produced by decomposing a desired full color image into yellow, cyan, magenta, and black image data. The developing devices 7 supply yellow, cyan, magenta, and black toners to the electrostatic latent images formed on the photoconductors 5, visualizing the electrostatic latent images as yellow, cyan, magenta, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each of the primary transfer nips formed between the photoconductors 5 and the primary transfer rollers 31, respectively.

When the yellow, cyan, magenta, and black toner images formed on the photoconductors 5 reach the primary transfer nips, respectively, in accordance with rotation of the photoconductors 5, the yellow, cyan, magenta, and black toner images are primarily transferred from the photoconductors 5 onto the intermediate transfer belt 30 by the transfer electric field created at the primary transfer nips such that the yellow, cyan, magenta, and black toner images are superimposed successively on a same position on the intermediate transfer belt 30. Thus, a full color toner image is formed on the outer circumferential surface of the intermediate transfer belt 30. After the primary transfer of the yellow, cyan, magenta, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, cyan, magenta, and black toners constructing the full color toner image formed on the intermediate transfer belt 30, thus creating a transfer electric field at the secondary transfer nip.

As the yellow, cyan, magenta, and black toner images constructing the full color toner image on the intermediate transfer belt 30 reach the secondary transfer nip in accordance with rotation of the intermediate transfer belt 30, the transfer electric field created at the secondary transfer nip secondarily transfers the yellow, cyan, magenta, and black toner images from the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into a waste toner container situated inside the image forming apparatus 1.

Thereafter, the sheet P bearing the full color toner image is conveyed to the fixing device 20 that fixes the full color toner image on the sheet P. The sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4C, 4M, and 4K or may form a bicolor toner image or a tricolor toner image by using two or three of the image forming devices 4Y, 4C, 4M, and 4K.

Figure 2:
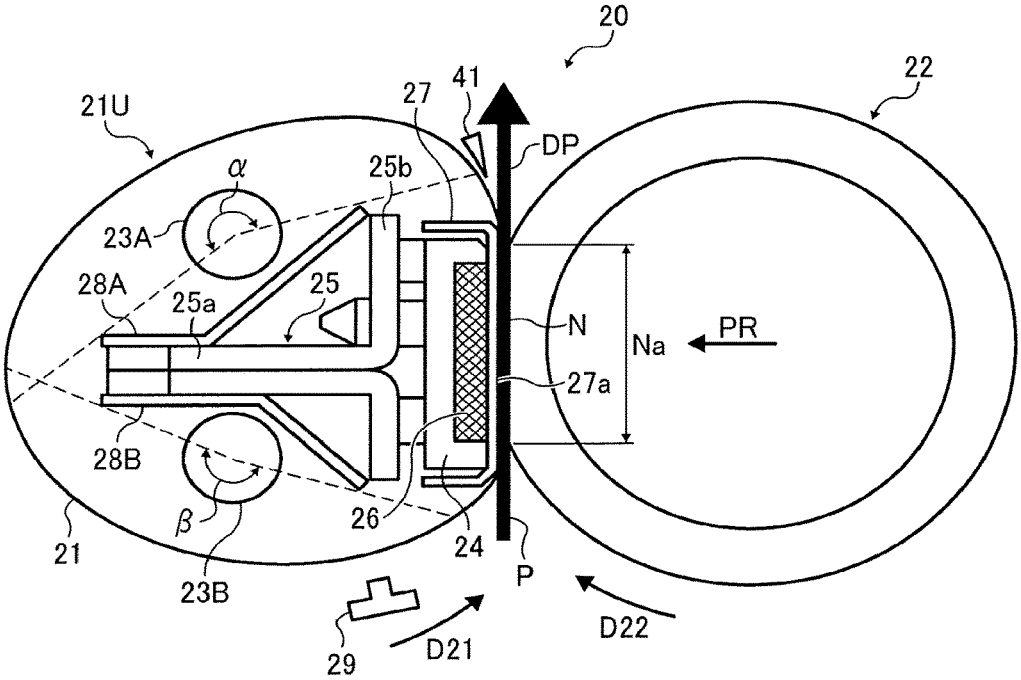
FIG. 2 is a vertical cross-sectional view of a fixing device incorporated in the image forming apparatus depicted in FIG. 1.

Referring to FIG. 2, a description is provided of a construction of the fixing device 20 incorporated in the image forming apparatus 1 having the construction described above.

FIG. 2 is a schematic vertical cross-sectional view of the fixing device 20. The fixing device 20 (e.g., a fuser or a fusing unit) includes a fixing belt 21 and a pressure roller 22. The fixing belt 21, serving as a fixing rotator, is an endless belt that is thin, flexible, tubular, and rotatable in a rotation direction D21. The pressure roller 22, serving as a pressure rotator, contacts an outer circumferential surface of the fixing belt 21. The pressure roller 22 is rotatable in a rotation direction D22. Inside a loop formed by the fixing belt 21 is a plurality of heaters or a plurality of fixing heaters, that is, a halogen heater 23A serving as a first radiant heater and a halogen heater 23B serving as a second radiant heater that heat the fixing belt 21 with radiant heat. Each of the halogen heaters 23A and 23B is a radiant heater serving as a main heater or a fixing heater.

Inside the loop formed by the fixing belt 21 are a nip formation pad 24, a stay 25, lateral end heaters 26, a thermal conduction aid 27, and reflectors 28A and 28B. The components disposed inside the loop formed by the fixing belt 21, that is, the halogen heaters 23A and 23B, the nip formation pad 24, the stay 25, the lateral end heaters 26, the thermal conduction aid 27, and the reflectors 28A and 28B, may construct a belt unit 21U separably coupled with the pressure roller 22. The nip formation pad 24 presses against the pressure roller 22 via the fixing belt 21 to form a fixing nip N between the fixing belt 21 and the pressure roller 22. The stay 25, serving as a support, supports the nip formation pad 24.

A detailed description is now given of a configuration of the nip formation pad 24.

The nip formation pad 24 extending in a longitudinal direction thereof parallel to an axial direction of the fixing belt 21 is secured to and supported by the stay 25. Accordingly, even if the nip formation pad 24 receives pressure from the pressure roller 22, the stay 25 prevents the nip formation pad 24 from being bent by the pressure and therefore allows the nip formation pad 24 to produce a uniform nip length throughout the entire width of the pressure roller 22 in an axial direction or a longitudinal direction thereof.

The nip formation pad 24 is made of a heat resistant material being resistant against temperatures up to 200 degrees centigrade and having an enhanced mechanical strength. For example, the nip formation pad 24 is made of heat resistant resin such as polyimide (PI), polyether ether ketone (PEEK), and PI or PEEK reinforced with glass fiber. Thus, the nip formation pad 24 is immune from thermal deformation at temperatures in a fixing temperature range desirable to fix a toner image on a sheet P, retaining the shape of the fixing nip N and quality of the toner image formed on the sheet P.

Both lateral ends of the stay 25 and the halogen heaters 23A and 23B in a longitudinal direction thereof are secured to and supported by a pair of side plates of the fixing device 20 or a pair of holders, provided separately from the pair of side plates, respectively.

A detailed description is now given of a configuration of the lateral end heaters 26.

The lateral end heaters 26 are mounted on or coupled with both lateral ends of the nip formation pad 24 in the longitudinal direction thereof, respectively. The lateral end heaters 26 serve as a sub heater provided separately from the main heater or the fixing heater (e.g., the halogen heaters 23A and 23B). The lateral end heaters 26 heat both lateral ends of the fixing belt 21 in the axial direction thereof, respectively. The lateral end heater 26 is a contact heater that contacts the fixing belt 21 to conduct heat to the fixing belt 21, for example, a resistive heat generator such as a ceramic heater.

A detailed description is now given of a configuration of the thermal conduction aid 27.

The thermal conduction aid 27 also serves as a thermal equalizer that facilitates conduction of heat in the axial direction of the fixing belt 21. The thermal conduction aid 27 covers a nip-side face of each of the nip formation pad 24 and the lateral end heaters 26, which is disposed opposite an inner circumferential surface of the fixing belt 21. The thermal conduction aid 27 conducts and equalizes heat in a longitudinal direction of the thermal conduction aid 27 that is parallel to the axial direction of the fixing belt 21, preventing heat from being stored at both lateral ends of the fixing belt 21 in the axial direction thereof while a plurality of small sheets P is conveyed over the fixing belt 21 or while the lateral end heaters 26 are turned on. Thus, the thermal conduction aid 27 eliminates uneven temperature of the fixing belt 21 in the axial direction thereof. Hence, the thermal conduction aid 27 is made of a material that conducts heat quickly, for example, a material having an enhanced thermal conductivity such as copper having a thermal conductivity of 398 W/mk and aluminum having a thermal conductivity of 236 W/mk.

The thermal conduction aid 27 includes a nip-side face 27*a* being disposed opposite and in direct contact with the inner circumferential surface of the fixing belt 21, thus serving as a nip formation face that forms the fixing nip N. As illustrated in FIG. 2, the nip-side face 27*a* is planar. Alternatively, the nip-side face 27*a* may be curved or recessed or may have other shapes. If the nip-side face 27*a* is recessed with respect to the pressure roller 22, the nip-side face 27*a* directs a leading edge of the sheet P toward the pressure roller 22 as the sheet P is ejected from the fixing nip N, facilitating separation of the sheet P from the fixing belt 21 and suppressing jamming of the sheet P between the fixing belt 21 and the pressure roller 22.

A temperature sensor 29 is disposed opposite the outer circumferential surface of the fixing belt 21 at a proper position thereon, for example, a position upstream from the fixing nip N in the rotation direction D21 of the fixing belt 21. The temperature sensor 29 detects the temperature of the fixing belt 21. A separator 41 is disposed downstream from the fixing nip N in the sheet conveyance direction DP to separate the sheet P from the fixing belt 21. A pressurization assembly presses the pressure roller 22 against the nip formation pad 24 via the fixing belt 21 and releases pressure exerted by the pressure roller 22 to the fixing belt 21.

A detailed description is now given of a construction of the fixing belt 21.

In order to decrease a thermal capacity of the fixing belt 21, the fixing belt 21, that is, an endless belt being thin like film and having a downsized loop diameter, is constructed of a base layer serving as the inner circumferential surface of the fixing belt 21 and a release layer serving as the outer circumferential surface of the fixing belt 21. The base layer is made of metal such as nickel and SUS stainless steel or resin such as PI. The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer. While the fixing belt 21 and the pressure roller 22 pressingly sandwich the unfixed toner image on the sheet P to fix the toner image on the sheet P, the elastic layer having a thickness of about 100 micrometers elastically deforms to absorb slight surface asperities of the fixing belt 21, preventing variation in gloss of the toner image on the sheet P.

In order to decrease the thermal capacity of the fixing belt 21, the fixing belt 21 has a total thickness not greater than 1 mm and a loop diameter in a range of from 20 mm to 40 mm. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. In order to decrease the thermal capacity of the fixing belt 21 further, the fixing belt 21 may have a total thickness not greater than 0.20 mm and preferably not greater than 0.16 mm. The loop diameter of the fixing belt 21 is not greater than 30 mm.

A detailed description is now given of a construction of the stay 25.

The stay 25, having a T-shape in cross-section, includes a base 25*b* disposed opposite the fixing nip N and an arm 25*a* projecting from the base 25*b* and being disposed opposite the nip formation pad 24 via the base 25*b*. In other words, the arm 25*a* of the stay 25 projects from the nip formation pad 24 in a pressurization direction PR in which the pressure roller 22 presses against the nip formation pad 24 via the fixing belt 21. The arm 25*a* is interposed between the halogen heaters 23A and 23B serving as the main heater to screen the halogen heater 23A from the halogen heater 23B.

A detailed description is now given of a construction of the halogen heaters 23A and 23B.

The halogen heater 23A includes a center heat generator disposed in a center span of the halogen heater 23A in the longitudinal direction thereof. A small sheet P is disposed opposite the center heat generator of the halogen heater 23A. The halogen heater 23B includes a lateral end heat generator disposed in each lateral end span of the halogen heater 23B in the longitudinal direction thereof. A large sheet P is disposed opposite the lateral end heat generator of the halogen heater 23B. The power supply situated inside the image forming apparatus 1 supplies power to the halogen heaters 23A and 23B so that the halogen heaters 23A and 23B generate heat. A controller described below, that is operatively connected to the halogen heaters 23A and 23B and the temperature sensor 29, controls the halogen heaters 23A and 23B based on the temperature of the outer circumferential surface of the fixing belt 21, which is detected by the temperature sensor 29 disposed opposite the outer circumferential surface of the fixing belt 21. Thus, the temperature of the fixing belt 21 is adjusted to a desired fixing temperature.

A detailed description is now given of a configuration of the reflectors 28A and 28B.

The reflector 28A is interposed between the halogen heater 23A and the stay 25. The reflector 28B is interposed between the halogen heater 23B and the stay 25. The reflectors 28A and 28B reflect light and heat radiated from the halogen heaters 23A and 23B to the reflectors 28A and 28B, respectively, toward the fixing belt 21, thus enhancing heating efficiency of the halogen heaters 23A and 23B to heat the fixing belt 21. Additionally, the reflectors 28A and 28B prevent light and heat radiated from the halogen heaters 23A and 23B from heating the stay 25 with radiant heat, suppressing waste of energy. Alternatively, instead of the reflectors 28A and 28B, an opposed face of the stay 25 disposed opposite the halogen heaters 23A and 23B may be treated with insulation or mirror finish to reflect light and heat radiated from the halogen heaters 23A and 23B to the stay 25 toward the fixing belt 21.

A detailed description is now given of a construction of the pressure roller 22.

The pressure roller 22 is constructed of a cored bar; an elastic layer coating the cored bar and being made of silicone rubber foam, fluoro rubber, or the like; and a release layer coating the elastic layer and being made of PFA, PTFE, or the like. The pressurization assembly such as a spring presses the pressure roller 22 against the fixing belt 21 to form the fixing nip N. The pressure roller 22 pressingly contacting the fixing belt 21 deforms the elastic layer of the pressure roller 22 at the fixing nip N formed between the pressure roller 22 and the fixing belt 21, thus defining the fixing nip N having a predetermined length in the sheet conveyance direction DP.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

In a nip span Na of the fixing nip N, the fixing belt 21 rotates as the fixing belt 21 is sandwiched between the pressure roller 22 and the nip formation pad 24; in a circumferential span of the fixing belt 21 other than the nip span Na, the fixing belt 21 rotates while the fixing belt 21 is guided by flanges secured to the pair of side plates at both lateral ends of the fixing belt 21 in the axial direction thereof, respectively.

According to this exemplary embodiment, the pressure roller 22 is a solid roller. Alternatively, the pressure roller 22 may be a hollow roller. In this case, a heater such as a halogen heater may be disposed inside the hollow roller. The elastic layer of the pressure roller 22 may be made of solid rubber. Alternatively, if no heater is situated inside the pressure roller 22, the elastic layer of the pressure roller 22 may be made of sponge rubber. The sponge rubber is more preferable than the solid rubber because the sponge rubber has an increased insulation that draws less heat from the fixing belt 21.

Figure 3:
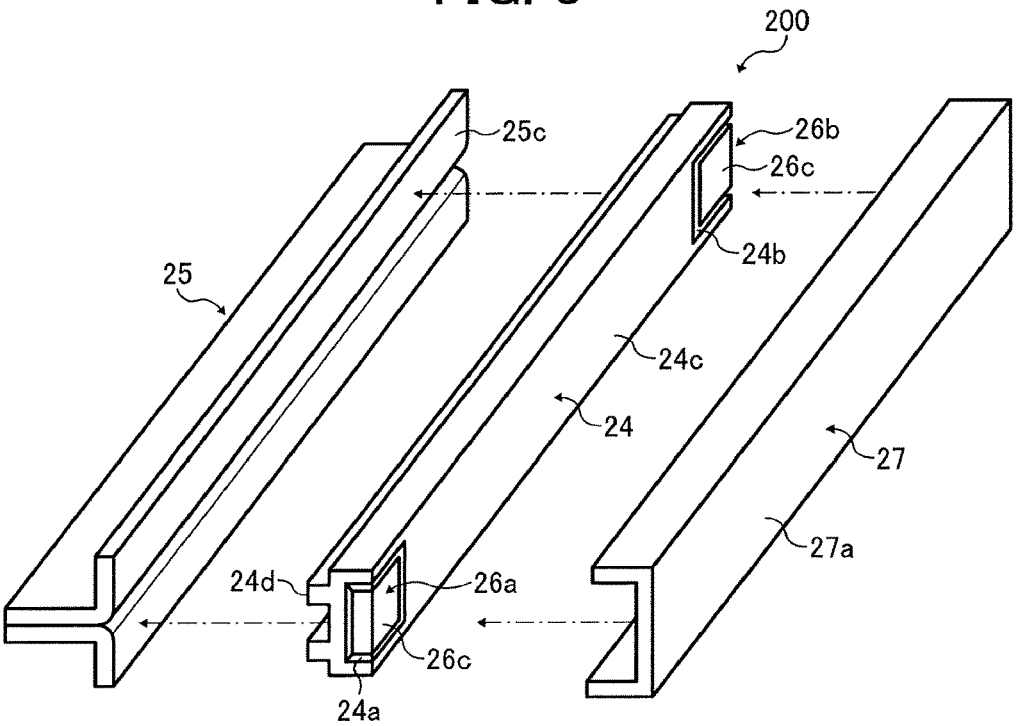
FIG. 3 is a perspective view of a nip formation unit incorporated in the fixing device depicted in FIG. 2.

Referring to FIG. 3, a description is provided of a construction of a nip formation unit 200 incorporated in the fixing device 20 depicted in FIG. 2.

FIG. 3 is a perspective view of the nip formation unit 200, illustrating a basic structure of the nip formation unit 200. As illustrated in FIG. 3, the nip formation unit 200 includes the nip formation pad 24, the stay 25, the thermal conduction aid 27, and lateral end heaters 26*a* and 26*b* illustrated as the lateral end heaters 26 in FIG. 2. The nip formation pad 24 includes a nip-side face 24*c* facing the fixing nip N and a stay-side face 24*d* being opposite the nip-side face 24*c* and facing the stay 25. The stay 25 includes a nip-side face 25*c* being planar and facing the fixing nip N. The stay-side face 24*d* of the nip formation pad 24 contacts the nip-side face 25*c* of the stay 25. For example, the stay-side face 24*d* of the nip formation pad 24 and the nip-side face 25*c* of the stay 25 mount a recess and a projection (e.g., a boss and a pin), respectively, so that the stay-side face 24*d* engages the nip-side face 25*c* to restrict each other with the shape of the stay-side face 24*d* and the nip-side face 25*c*. The thermal conduction aid 27 engages the nip formation pad 24 that is substantially rectangular such that the thermal conduction aid 27 covers the nip-side face 24*c* of the nip formation pad 24 that is disposed opposite the inner circumferential surface of the fixing belt 21. Thus, the thermal conduction aid 27 is coupled with the nip formation pad 24. For example, the thermal conduction aid 27 is coupled with the nip formation pad 24 with a claw, an adhesive, or the like.

Two recesses 24*a* and 24*b*, each of which defines a difference in thickness of the nip formation pad 24, are disposed at both lateral ends of the nip formation pad 24 in the longitudinal direction thereof, respectively. The lateral end heaters 26*a* and 26*b* are secured to the recesses 24*a* and 24*b*, thus being accommodated by the recesses 24*a* and 24*b*, respectively. A description of a positional relation between the lateral end heaters 26*a* and 26*b* and the halogen heaters 23A and 23B is deferred.

The thermal conduction aid 27 includes the nip-side face 27*a* that is disposed opposite the inner circumferential surface of the fixing belt 21. The nip-side face 27*a* serves as a slide face over which the fixing belt 21 slides. However, since the nip-side face 24*c* of the nip formation pad 24 has a mechanical strength greater than that of the nip-side face 27*a* of the thermal conduction aid 27, the nip-side face 24*c* of the nip formation pad 24 serves as a nip formation face that faces the pressure roller 22 and forms the fixing nip N practically.

According to this exemplary embodiment, the lateral end heaters 26*a* and 26*b* are coupled with the nip formation pad 24 to form the fixing nip N. Hence, the lateral end heaters 26*a* and 26*b* are situated inside a limited space inside the loop formed by the fixing belt 21, saving space.

Each of the lateral end heaters 26*a* and 26*b* includes a nip-side face 26*c* disposed opposite the inner circumferential surface of the fixing belt 21. The nip-side face 26*c* of each of the lateral end heaters 26*a* and 26*b* is leveled with the nip-side face 24*c* of the nip formation pad 24 that is disposed opposite the inner circumferential surface of the fixing belt 21 in the pressurization direction PR depicted in FIG. 2 in which the pressure roller 22 presses against the nip formation pad 24 so that the nip-side faces 26*c* and the nip-side face 24*c* define an identical plane. Accordingly, the pressure roller 22 is pressed against the lateral end heaters 26*a* and 26*b* via the fixing belt 21 and the thermal conduction aid 27 sufficiently.

Consequently, the fixing belt 21 rotates stably in a state in which the fixing belt 21 is pressed against the lateral end heaters 26*a* and 26*b* or adhered to the lateral end heaters 26*a* and 26*b* indirectly via the thermal conduction aid 27. The fixing belt 21 is pressed against the lateral end heaters 26*a* and 26*b* with sufficient pressure, retaining improved heating efficiency of the lateral end heaters 26*a* and 26*b*. Hence, the fixing device 20 enhances reliability.

A description is provided of a construction of a comparative fixing device.

An image forming apparatus incorporating the comparative fixing device may form a toner image on sheets of various sizes. If the comparative fixing device includes a heater having a width that is equivalent to a width of a large sheet, even when a plurality of small sheets is conveyed over a fixing belt continuously, the heater may heat a non-conveyance span of the fixing belt where the small sheets are not conveyed. Accordingly, the non-conveyance span, situated at each lateral end of the fixing belt in an axial direction thereof, may overheat because the small sheets do not draw heat from the non-conveyance span of the fixing belt.

To address this circumstance, the comparative fixing device may include a first halogen heater having a dense light distribution in a center span of the first halogen heater in a longitudinal direction thereof and a second halogen heater having a dense light distribution in each lateral end span of the second halogen heater in a longitudinal direction thereof. The first halogen heater and the second halogen heater are disposed inside a loop formed by the fixing belt. When a small sheet is conveyed over the fixing belt, the first halogen heater is powered on. When a large sheet greater than the small sheet is conveyed over the fixing belt, both the second halogen heater and the first halogen heater are powered on.

Additionally, the image forming apparatus incorporating the comparative fixing device may form a toner image on an extra-large sheet (e.g., an A3 extension size sheet and a 13-inch sheet) greater than the large sheet (e.g., an A3 size sheet).

To address this circumstance, the comparative fixing device may further include lateral end heaters that heat both outboard spans of the fixing belt, respectively. Each of the outboard spans of the fixing belt is disposed outboard from each lateral end span of the fixing belt in the axial direction thereof, which is heated by the second halogen heater. The outboard spans are disposed opposite the extra-large sheet. The lateral end heaters are disposed upstream from a fixing nip in a rotation direction of the fixing belt. The lateral end heaters contact an inner circumferential surface or an outer circumferential surface of the fixing belt.

If the lateral end heaters press against the fixing belt with increased pressure to enhance heat conduction efficiency of heat conducted from the lateral end heaters to the fixing belt, the lateral end heaters contact the fixing belt with an increased friction therebetween, degrading rotation of the fixing belt and reliability.

Conversely, if the lateral end heaters contact the fixing belt with decreased pressure to improve rotation of the fixing belt, the lateral end heaters may heat the fixing belt insufficiently. Accordingly, the lateral end heaters may overheat, degrading reliability.

Additionally, the lateral end heaters may melt residual toner failed to be fixed on a previous sheet at the fixing nip and therefore remaining on the fixing belt again on both outboard spans of the fixing belt in the axial direction thereof, which contact the lateral end heaters, respectively. The melted toner may adhere to the fixing belt and damage a toner image on a subsequent sheet, degrading quality of the toner image on the subsequent sheet.

Since the comparative fixing device is requested to shorten a first print time taken to eject a sheet bearing a fixed toner image upon receipt of a print job, the comparative fixing device may confront a circumstance described below.

The comparative fixing device may further include a nip formation pad that contacts an inner circumferential surface of the fixing belt. While the fixing belt rotates, the inner circumferential surface of the fixing belt slides over a slide face of the nip formation pad. Accordingly, the slide face of the nip formation pad is applied with a lubricant such as fluorine grease and silicone oil to decrease a slide torque of the fixing belt. Since the nip formation pad retains the fluorine grease precisely, the fluorine grease is advantageous against increase in the slide torque of the fixing belt over time.

However, the viscosity of the fluorine grease may change as the temperature of the fluorine grease changes. The comparative fixing device is requested to start quickly to shorten the first print time. However, at a low temperature, the viscosity of the fluorine grease increases and therefore a starting torque to start the comparative fixing device increases. Accordingly, a driving motor that generates an increased torque to drive the fixing belt may be installed in the comparative fixing device, increasing manufacturing costs.

Further, as the driving motor rotates the fixing belt with the increased torque, in addition to the fixing belt, gears and the like used to drive components of the comparative fixing device are imposed with an increased load. Accordingly, the fixing belt, the comparative fixing device incorporating the fixing belt, and the image forming apparatus incorporating the comparative fixing device may suffer from a shortened life.

Contrarily to the lateral end heaters of the comparative fixing device, the lateral end heaters 26*a* and 26*b* of the fixing device 20 depicted in FIGS. 2 and 3 are disposed opposite the fixing nip N. Accordingly, the lateral end heaters 26*a* and 26*b* heat the fixing belt 21 in the nip span Na in the rotation direction D21 of the fixing belt 21. That is, the lateral end heaters 26*a* and 26*b* do not heat the fixing belt 21 in the circumferential span outboard from the nip span Na in the rotation direction D21 of the fixing belt 21 unlike the lateral end heaters of the comparative fixing device that are disposed upstream from the fixing nip in the rotation direction of the fixing belt to heat the fixing belt in a circumferential span outboard from the fixing nip in the rotation direction of the fixing belt. Hence, the lateral end heaters 26*a* and 26*b* of the fixing device 20 prevent residual toner failed to be fixed on a previous sheet P and therefore adhering to the fixing belt 21 from being melted again and degrading a toner image on a subsequent sheet P.

Figure 4:
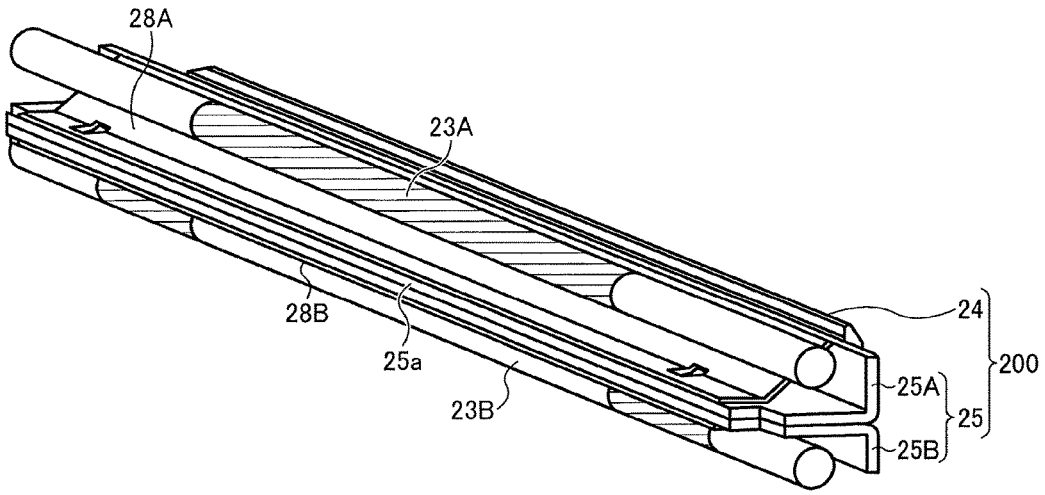
FIG. 4 is a perspective view of the nip formation unit depicted in FIG. 3 and halogen heaters incorporated in the fixing device depicted in FIG. 2.

FIG. 4 is a perspective view of the nip formation unit 200 and the halogen heaters 23A and 23B. As illustrated in FIG. 4, the stay 25 includes a first portion 25A and a second portion 25B, each of which is substantially L-shaped in cross-section. Thus, the stay 25 is substantially T-shaped in cross-section. Accordingly, the stay 25 attains an enhanced rigidity that prevents the nip formation pad 24 from being bent by pressure from the pressure roller 22. The stay 25 constructed of the first portion 25A and the second portion 25B extends linearly in the longitudinal direction of the nip formation pad 24. The stay 25 is secured to the nip formation pad 24. Accordingly, the stay 25 renders the nip-side face 24*c* depicted in FIG. 3 of the nip formation pad 24 to form the fixing nip N precisely throughout the entire width of the fixing nip N in the longitudinal direction of the nip formation pad 24.

As illustrated in FIG. 4, the halogen heater 23A is disposed opposite the halogen heater 23B via the arm 25*a* of the stay 25 in a short direction perpendicular to the longitudinal direction of the stay 25. The arm 25*a* is interposed between the halogen heaters 23A and 23B to screen the halogen heater 23A from the halogen heater 23B. Accordingly, while the halogen heaters 23A and 23B are powered on, glass tubes of the halogen heaters 23A and 23B, respectively, do not heat each other, preventing degradation in heating efficiency of the halogen heaters 23A and 23B. As illustrated in FIG. 2, each of the halogen heaters 23A and 23B is not surrounded by the stay 25. For example, a center of each of the halogen heaters 23A and 23B in cross-section is outside a space defined or enclosed by the stay 25. Accordingly, the halogen heaters 23A and 23B attain obtuse irradiation angles $\alpha$ and $\beta$, respectively, of light that irradiates the fixing belt 21, thus improving heating efficiency.

Alternatively, the stay 25 may have shapes other than the substantially T-shape in cross-section. The first portion 25A and the second portion 25B depicted in FIG. 4 may curve and extend in the longitudinal direction of the halogen heaters 23A and 23B as long as the arm 25*a* interposed between the halogen heaters 23A and 23B screens the halogen heater 23A from the halogen heater 23B. The arm 25*a* of each of the first portion 25A and the second portion 25B may be oblique relative to the nip-side face 24*c* of the nip formation pad 24.

A description is provided of arrangement of the lateral end heaters 26*a* and 26*b* to correspond to sheets P of special sizes such as an A3 extension size sheet.

Figure 5:
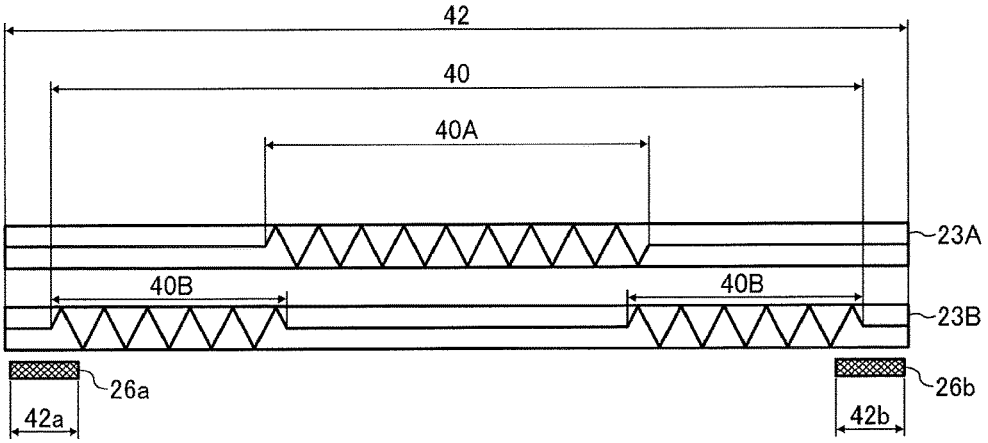
FIG. 5 is a diagram of the halogen heaters depicted in FIG. 4 and lateral end heaters incorporated in the nip formation unit depicted in FIG. 3.

FIG. 5 is a diagram of the halogen heaters 23A and 23B and the lateral end heaters 26*a* and 26*b*, illustrating arrangement thereof. As illustrated in FIG. 5, the halogen heater 23A includes a heat generator 40A serving as a center heat generator having a dense light distribution in the center span of the halogen heater 23A, which is disposed opposite a center span of the fixing belt 21 in the axial direction thereof. The halogen heater 23B includes a heat generator 40B serving as a lateral end heat generator having a dense light distribution in each lateral end span of the halogen heater 23B, which is disposed opposite each lateral end span of the fixing belt 21 in the axial direction thereof. The heat generator 40B is disposed outboard from the heat generator 40A in the axial direction of the fixing belt 21. The halogen heater 23A heats the center span of the fixing belt 21 in the axial direction thereof. The halogen heater 23B heats each lateral end span of the fixing belt 21 in the axial direction thereof.

The heat generator 40A of the halogen heater 23A corresponds to small sheets P of small sizes such as an A4 size sheet in portrait orientation. The heat generator 40B of the halogen heater 23B corresponds to large sheets P of large sizes such as an A3 size sheet in portrait orientation. The heat generator 40B is disposed outboard from the heat generator 40A in the longitudinal direction of the halogen heater 23A so that the heat generator 40B heats a lateral end of the large sheet P that is outboard from the heat generator 40A in the longitudinal direction of the halogen heater 23B. The large sheets P include a maximum standard size sheet available in the fixing device 20. A heat generator 40, that is, a first combined heat generator constructed of or defined by the heat generators 40A and 40B, corresponds to a width of the maximum standard size sheet (e.g., the A3 size sheet in portrait orientation) and does not encompass a width of an extra-large sheet P of an extension size, which is greater than the width of the maximum standard size sheet.

The lateral end heaters 26*a* and 26*b* are disposed opposite both lateral ends of the halogen heater 23B in the longitudinal direction thereof, respectively. The lateral end heaters 26*a* and 26*b* include heat generators 42*a* and 42*b* that heat both lateral ends of the extra-large sheet P greater than the maximum standard size sheet in the longitudinal direction of the halogen heater 23B, respectively. Thus, a heat generator 42, that is, a second combined heat generator constructed of or defined by the heat generators 40A, 40B, 42*a*, and 42*b*, corresponds to the width of the extra-large sheet P of the extension size (e.g., the A3 extension size sheet and the 13-inch sheet). A part of each of the heat generators 42*a* and 42*b* overlaps the heat generator 40B in the longitudinal direction of the halogen heater 23B. Accordingly, the fixing belt 21 of the fixing device 20 heats both lateral ends of the extra-large sheet P greater than the maximum standard size sheet in the longitudinal direction of the halogen heater 23B.

A description is provided of an amount of heat output by the halogen heaters 23A and 23B and the lateral end heaters 26*a* and 26*b* to heat the fixing belt 21.

Figure 6:
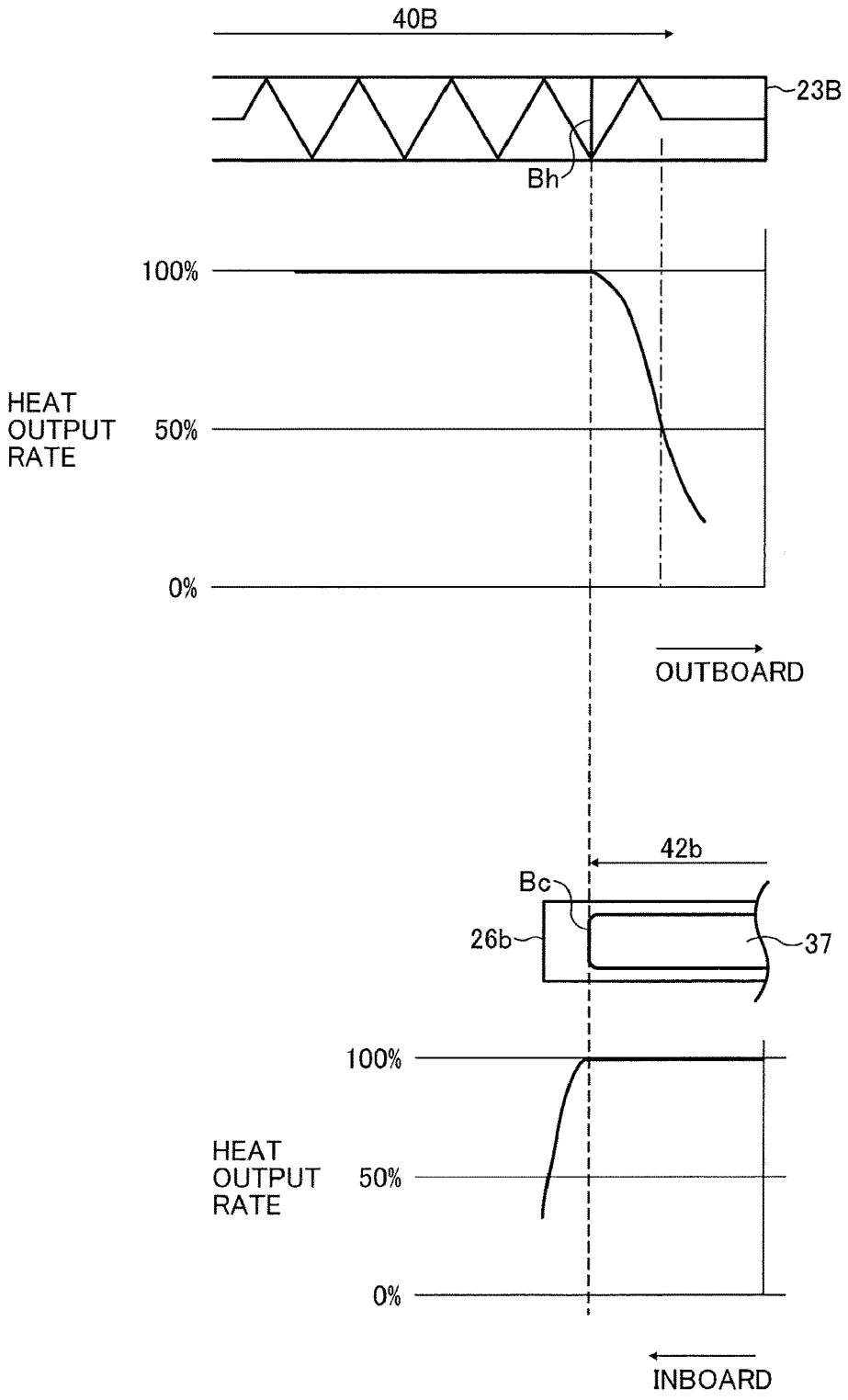
FIG. 6 is a diagram illustrating a positional relation between a heat generator of the halogen heater and a heat generator of the lateral end heater depicted in FIG. 5 and heat output from the heat generators.

FIG. 6 is a diagram illustrating a positional relation between the heat generator 40B of the halogen heater 23B and the heat generator 42*b* of the lateral end heater 26*b* and a heat output rate of the heat generators 40B and 42*b*. An upper part of FIG. 6 illustrates a right lateral end of the heat generator 40B of the halogen heater 23B. A lower part of FIG. 6 illustrates a left lateral end of the heat generator 42*b* of the lateral end heater 26*b*.

Generally, a heat generator, in which a filament is coiled helically, of a halogen heater suffers from decrease in heat output at a lateral end of the heat generator in a longitudinal direction of the halogen heater. The decrease in heat output varies depending on a density of the filament coiled helically. The smaller the density of the filament coiled helically is, the more the halogen heater is susceptible to the decrease in heat output. As illustrated in the upper part in FIG. 6, a lateral end of the heat generator 40B in the longitudinal direction of the halogen heater 23B, which suffers from the decrease in heat output is defined as a span from a position at which the heat generator 40B attains a predetermined heat output rate of 100 percent to a position at which the heat generator 40B suffers from a decreased heat output rate of 50 percent, for example.

As illustrated in the lower part in FIG. 6, the heat generator 42*b* includes a heat generation pattern 37. A lateral end of the lateral end heater 26*b* that is inboard from the heat generator 42*b* in a longitudinal direction of the lateral end heater 26*b* suffers from the decrease in heat output. The lateral end of the lateral end heater 26*b* in the longitudinal direction thereof fails to attain the predetermined heat output rate of 100 percent and suffers from a decreased heat output rate.

Accordingly, as the lateral end of the halogen heater 23B and the lateral end heater 26*b* in the longitudinal direction thereof suffers from the decrease in heat output, a toner image formed on the lateral end of the extra-large sheet P greater than the maximum standard size sheet may not be fixed on the extra-large sheet P properly.

To address this circumstance, a border Bh at which heat output from the heat generator 40B of the halogen heater 23B starts decreasing corresponds to a border Bc at which heat output from the heat generator 42*b* of the lateral end heater 26*b* starts decreasing. Since the halogen heater 23B is spaced apart from the lateral end heater 26*b* as illustrated in FIG. 2, the border Bh coincides with the border Bc in the longitudinal direction of the halogen heater 23B on a projection. Similarly, the border Bh at which heat output from another heat generator 40B of the halogen heater 23B starts decreasing corresponds to the border Bc at which heat output from the heat generator 42*a* of the lateral end heater 26*a* depicted in FIG. 5 starts decreasing.

Accordingly, the heat generator 42 is immune from decrease in heat output in an overlap span where the heat generator 40B of the halogen heater 23B overlaps the lateral end heater 26*a* and an overlap span where the heat generator 40B of the halogen heater 23B overlaps the lateral end heater 26*b* in the longitudinal direction of the halogen heater 23B, thus retaining the predetermined heat output rate of 100 percent. Consequently, even when the extra-large sheet P greater than the maximum standard size sheet is conveyed over the fixing belt 21, the toner image formed on each lateral end of the extra-large sheet P in a width direction of the extra-large sheet P is fixed on the extra-large sheet P properly.

As illustrated in FIG. 6, the border Bh at which heat output from the heat generator 40B of the halogen heater 23B starts decreasing coincides with the border Bc at which heat output from the heat generator 42*b* of the lateral end heater 26*b* starts decreasing. However, as illustrated in FIG. 3, the nip formation unit 200 incorporates the thermal conduction aid 27 having an enhanced thermal conductivity that offsets a certain amount of decrease in heat output from the heat generators 40B and 42*b* and therefore equalizes the temperature of the fixing belt 21. Hence, the position of the border Bc at which heat output from the heat generators 42*a* and 42*b* of the lateral end heaters 26*a* and 26*b*, respectively, starts decreasing may be determined within a predetermined allowable range.

A description is provided of positioning of the border Bc, that is, an inboard lateral edge of the heat generator 42*b* of the lateral end heater 26*b* in the longitudinal direction of the lateral end heater 26*b*, at which heat output from the heat generator 42*b* starts decreasing.

Referring to graphs illustrating heat output from the halogen heaters 23A and 23B, positioning of the border Bc is explained with three patterns. The position of the border Bc is determined within the predetermined allowable range.

A description is provided of a first pattern of positioning of the border Bc.

Figure 7:
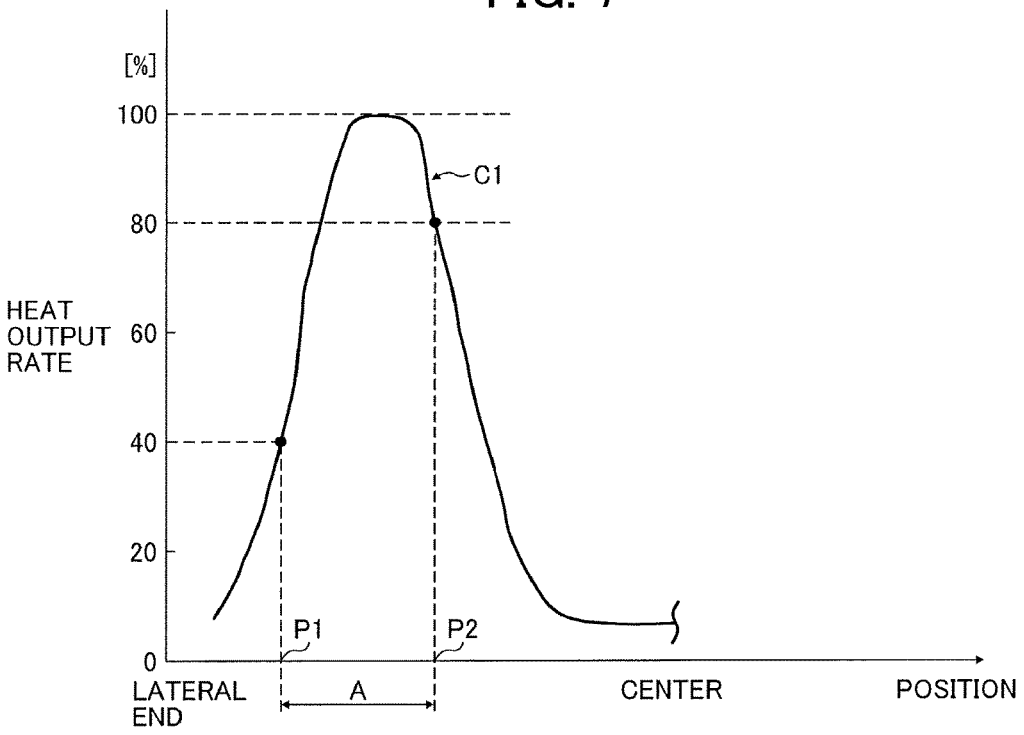
FIG. 7 is a graph illustrating a curve that represents a heat output rate of heat output from the halogen heater depicted in FIG. 5 under a first pattern.

FIG. 7 is a graph illustrating a curve C1 that represents a heat output rate of heat output from the halogen heater 23B serving as a second radiant heater under the first pattern. FIG. 7 illustrates heat output from one lateral end of the halogen heater 23B in the longitudinal direction thereof. In the graph depicted in FIG. 7, a vertical axis represents a heat output rate in percentage of the halogen heater 23B relative to a predetermined heat output rate. A horizontal axis represents the position of the halogen heater 23B in the longitudinal direction thereof. The graph depicted in FIG. 7 illustrates the curve C1 with a vertex like a parabola.

As illustrated in FIG. 7, the border Bc, that is, the inboard lateral edge of the heat generator 42*b* in the longitudinal direction of the lateral end heater 26*b*, at which heat output from the heat generator 42*b* of the lateral end heater 26*b* starts decreasing, is situated in a border span A. The border span A is defined from an outboard position P1 to an inboard position P2 in the longitudinal direction of the halogen heater 23B. At the outboard position P1, heat output from the heat generator 40B of the halogen heater 23B attains a heat output rate of 40 percent relative to a peak heat output rate. At the inboard position P2, heat output from the heat generator 40B of the halogen heater 23B attains a heat output rate of 80 percent relative to the peak heat output rate. The border Bc situated in the border span A renders the heat output rate of heat output from an inboard lateral end of the lateral end heater 26*b* and an outboard lateral end of the halogen heater 23B in the longitudinal direction thereof to be within the predetermined allowable range.

A description is provided of a second pattern of positioning of the border Bc.

Figure 8:
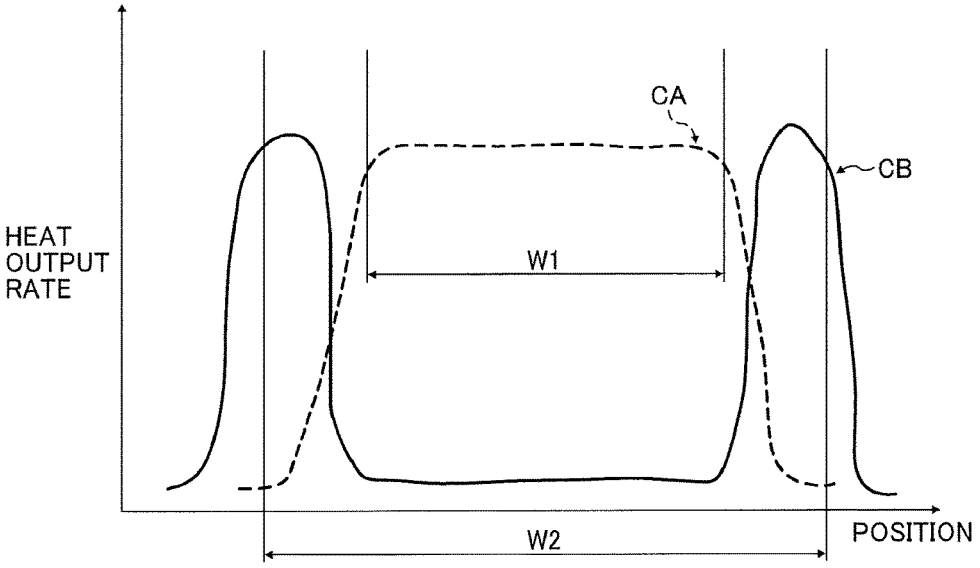
FIG. 8 is a graph illustrating a heat output rate of heat output from the halogen heaters depicted in FIG. 5 under a second pattern.

FIG. 8 is a graph illustrating a heat output rate of heat output from the halogen heater 23A having the heat generator 40A situated in the center span of the halogen heater 23A and the halogen heater 23B having the heat generators 40B situated in each lateral end span of the halogen heater 23B under the second pattern. In the graph depicted in FIG. 8, a curve CA in a dotted line represents heat output from the halogen heater 23A. A curve CB in a solid line represents heat output from the halogen heater 23B. A width W1 represents a width of an A4 size sheet in portrait orientation in the axial direction of the fixing belt 21. A width W2 represents a width of an A4 size sheet in landscape orientation in the axial direction of the fixing belt 21 as a width of the maximum standard size sheet. The halogen heaters 23A and 23B that have different light distributions in the longitudinal direction thereof and therefore have different heat output patterns provide different total heat output patterns, respectively.

Figure 9:
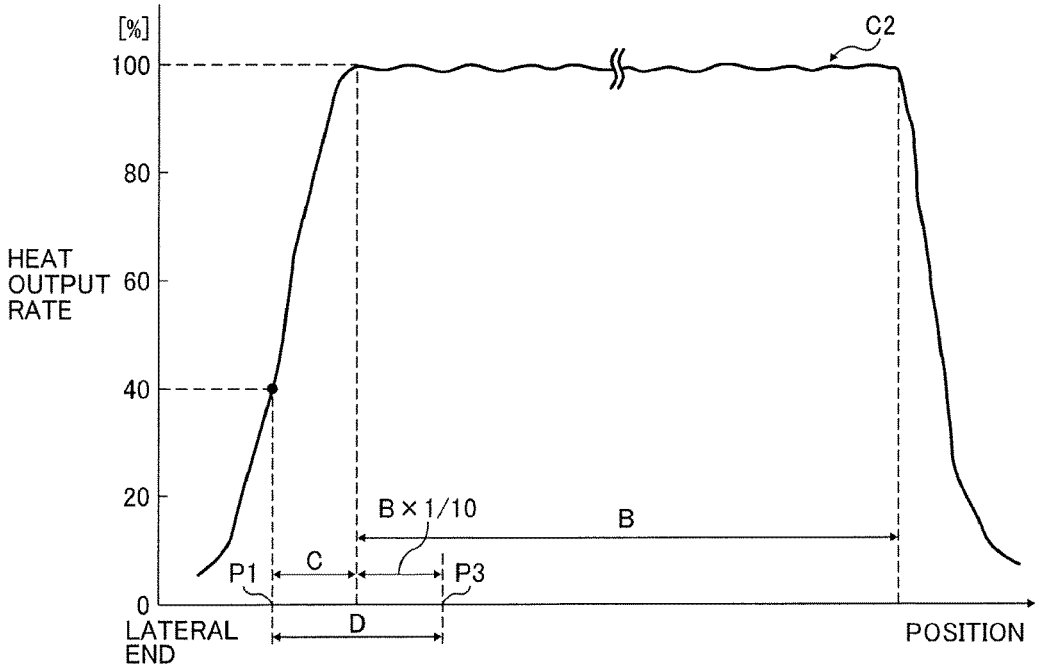
FIG. 9 is a graph illustrating a curve that represents a combined heat output rate of heat output from the halogen heaters depicted in FIG. 5 under the second pattern.

FIG. 9 is a graph illustrating a curve C2 that represents a combined heat output rate of heat output from the halogen heaters 23A and 23B under the second pattern. As illustrated in FIG. 9, the combined heat output rate of the halogen heaters 23A and 23B attains the predetermined heat output rate of 100 percent at a position in proximity to each lateral end of the halogen heater 23B in the longitudinal direction thereof and a heat output rate of almost 100 percent in the center span of the halogen heater 23A in the longitudinal direction thereof, rendering the curve C2 to be gentle.

In FIG. 9, a span B represents a first combined heat output span where the combined heat output rate of the halogen heaters 23A and 23B attains the heat output rate of almost 100 percent constantly. A span C represents a second combined heat output span where the combined heat output rate of the halogen heaters 23A and 23B attains a heat output rate in a range of from 40 percent to almost 100 percent. The border Bc is disposed in a border span D defined from the outboard position P1 where the halogen heater 23B attains the heat output rate of 40 percent to an inboard position P3 being inboard from the outboard position P1 in the longitudinal direction of the halogen heater 23B by the span C and one tenth of the span B. The border Bc situated in the border span D renders the heat output rate of the inboard lateral end of the lateral end heater 26*b* and the outboard lateral end of the halogen heater 23B in the longitudinal direction thereof to be within the predetermined allowable range.

A description is provided of a third pattern of positioning of the border Bc.

Figure 10:
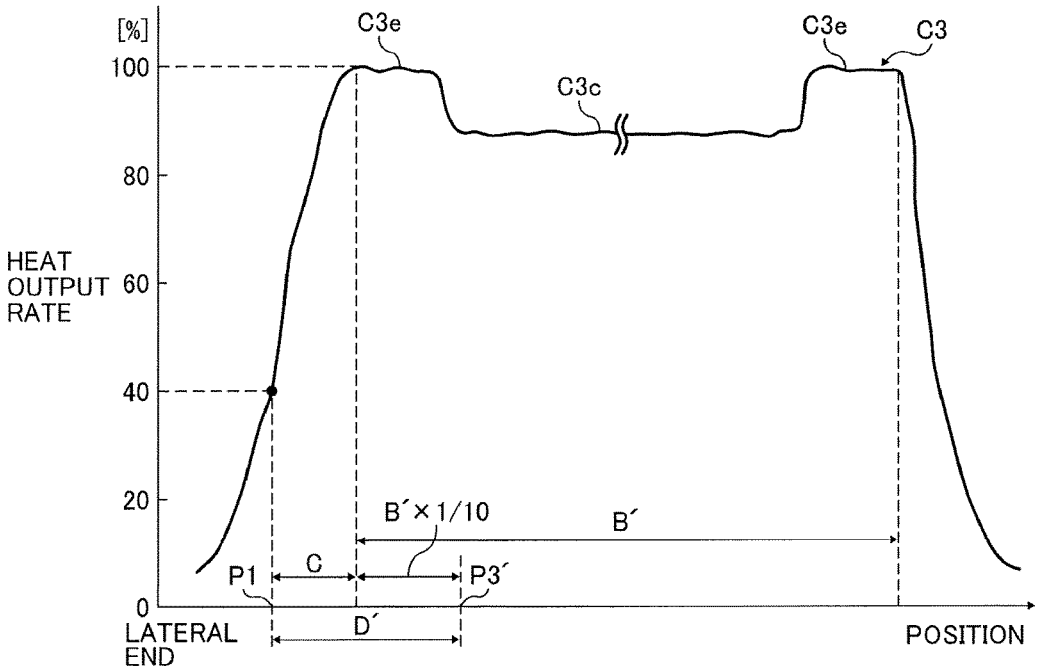
FIG. 10 is a graph illustrating a curve that represents a combined heat output rate of heat output from the halogen heaters depicted in FIG. 5 under a third pattern.

FIG. 10 is a graph illustrating a curve C3 that represents a combined heat output rate of heat output from the halogen heaters 23A and 23B under the third pattern as a variation. As illustrated in FIG. 10, a center part C3*c* of the curve C3 is gentle. Both lateral end parts C3*e* of the curve C3 indicate a heat output rate greater than a heat output rate indicated by the center part C3*c*. The curve C3 is obtained with the filament of each of the heat generators 40B of the halogen heater 23B, which is coiled more densely than the filament of the heat generator 40A of the halogen heater 23A.

In FIG. 10, a span B' represents a span where the combined heat output rate of the halogen heaters 23A and 23B attains the heat output rate of almost 100 percent. The span B' bridges the lateral end parts C3*e*. The span C represents the span where the combined heat output rate of the halogen heaters 23A and 23B attains the heat output rate in the range of from 40 percent to almost 100 percent. The border Bc is disposed in a border span D' defined from the outboard position P1 where the halogen heater 23B attains the heat output rate of 40 percent to an inboard position P3' being inboard from the outboard position P1 in the longitudinal direction of the halogen heater 23B by the span C and one tenth of the span B'. The border Bc situated in the border span D' renders the heat output rate of the inboard lateral end of the lateral end heater 26*b* and the outboard lateral end of the halogen heater 23B in the longitudinal direction thereof to be within the predetermined allowable range.

A description is provided of an advantageous configuration of the fixing device 20.

Since the inner circumferential surface of the fixing belt 21 slides over the thermal conduction aid 27, if the thermal conduction aid 27 is made of metal such as copper and aluminum, the thermal conduction aid 27 may increase a coefficient of friction between the fixing belt 21 and the thermal conduction aid 27. As the coefficient of friction increases, a unit torque of the fixing device 20 may increase, shortening a life of the fixing device 20.

To address this circumstance, as illustrated in FIG. 3, the thermal conduction aid 27 incorporates the nip-side face 27*a* being disposed opposite and in contact with the fixing belt 21 such that the fixing belt 21 slides over the nip-side face 27*a*. The nip-side face 27*a* is smooth and treated with processing to reduce friction. For example, the nip-side face 27*a* is coated with a fluorine material such as PFA and PTFE or treated with other coating to reduce friction between the thermal conduction aid 27 and the inner circumferential surface of the fixing belt 21. Alternatively, a lubricant such as fluorine grease and silicone oil is applied between the thermal conduction aid 27 and the inner circumferential surface of the fixing belt 21 to reduce friction further. For example, the inner circumferential surface of the fixing belt 21 is applied with the lubricant.

A description is provided of a configuration of another temperature detector separately provided from the temperature sensor 29 depicted in FIG. 2, which detects the temperature of the fixing belt 21 heated by the lateral end heater 26 (e.g., the lateral end heaters 26*a* and 26*b*).

A contact sensor (e.g., a thermistor) is employed to detect the temperature of the fixing belt 21 precisely at reduced costs. However, the contact sensor may produce slight scratches at a contact position on the fixing belt 21 where the contact sensor contacts the fixing belt 21. The slight scratches may damage a toner image formed on a sheet P while the sheet P is conveyed over the fixing belt 21, generating slight variation in gloss of the toner image on the sheet P or the like. To address this circumstance, in the image forming apparatus 1 that forms a color toner image on a sheet P, the contact sensor is not situated within a conveyance span in the axial direction of the fixing belt 21 where the maximum standard size sheet is conveyed over the fixing belt 21.

The extra-large sheet P, that is, an extension size sheet, includes an extension portion used as an edge or a margin abutting on a toner image formed in proximity to a lateral edge of the maximum standard size sheet, a portion where a linear image called a trim mark used for alignment in printing positions is formed, or a portion where a solid patch having a small area for color adjustment is formed. Finally, the extension portion is often trimmed. Hence, even if the contact sensor produces scratches on the fixing belt 21 and the scratches damage a toner image formed on the extension portion of the extra-large sheet P with slight variation in gloss of the toner image or the like, the damaged toner image does not appear on the extra-large sheet P as a faulty toner image after the extension portion is trimmed.

Figure 11:
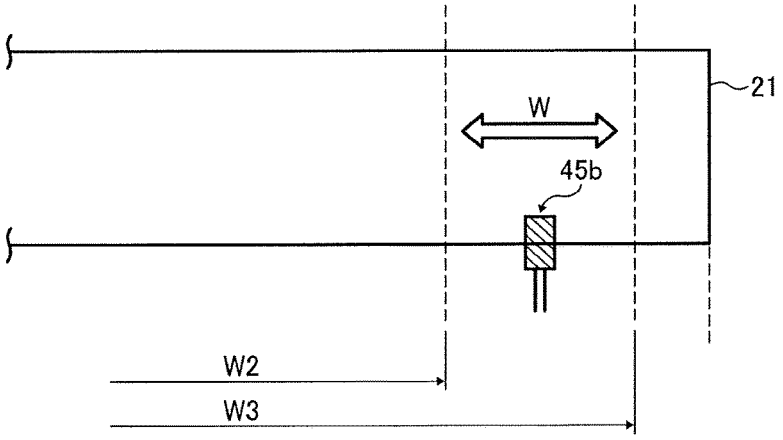
FIG. 11 is a plan view of a temperature detector and a fixing belt incorporated in the fixing device depicted in FIG. 2.

Accordingly, as illustrated in FIG. 11, the fixing device 20 according to this exemplary embodiment includes a plurality of temperature detectors 45*a* and 45*b*, disposed opposite both lateral ends of the fixing belt 21 in the axial direction thereof, to detect the temperature of both lateral ends of the fixing belt 21 that are heated by the lateral end heaters 26*a* and 26*b*, respectively.

A description is provided of a configuration of the temperature detectors 45*a* and 45*b*.

FIG. 11 is a plan view of the temperature detector 45*b* and the fixing belt 21. FIG. 11 omits illustration of the temperature detector 45*a* disposed symmetrical with the temperature detector 45*b*.

Each of the temperature detectors 45*a* and 45*b* is disposed opposite the outer circumferential surface of the fixing belt 21 and disposed outboard from the conveyance span of the maximum standard size sheet in the axial direction of the fixing belt 21. Each of the temperature detectors 45*a* and 45*b* is disposed within a span W being outboard from a lateral edge of the maximum standard size sheet and inboard from a lateral edge of the extra-large sheet P greater than the maximum standard size sheet in the axial direction of the fixing belt 21. Accordingly, the temperature detectors 45*a* and 45*b* detect the temperature of the fixing belt 21 heated by the lateral end heaters 26*a* and 26*b*, respectively, precisely at reduced costs while preventing a faulty toner image that suffers from slight variation in gloss or the like from appearing on the extra-large sheet P. FIG. 11 illustrates the width W2 of the A4 size sheet in landscape orientation in the axial direction of the fixing belt 21 as the width of the maximum standard size sheet and a width W3 of the extra-large sheet P in the axial direction of the fixing belt 21 as a width of a maximum extension size sheet.

Alternatively, a non-contact temperature detector that does not contact the fixing belt 21 may be employed to prevent a faulty toner image that suffers from slight variation in gloss or the like from appearing on the extension portion of the extra-large sheet P.

The above describes the configuration of the temperature detectors 45*a* and 45*b* that detect the temperature of both lateral ends of the fixing belt 21 that are heated by the lateral end heaters 26*a* and 26*b*, respectively. Alternatively, the fixing device 20 may include a sensor that detects the temperature of a part of the lateral end heaters 26*a* and 26*b* so that the controller controls the lateral end heaters 26*a* and 26*b* based on the temperature of the lateral end heaters 26*a* and 26*b* that is detected by the sensor.

A description is provided of a configuration of the fixing device 20 to fix a toner image on a sheet P quickly without increasing a load even at a low temperature.

As described above, the inner circumferential surface of the fixing belt 21 contacts and slides over the thermal conduction aid 27. The lubricant such as fluorine grease and silicone oil is applied between the thermal conduction aid 27 and the inner circumferential surface of the fixing belt 21 to reduce the coefficient of friction.

The nip-side face 27*a* of the thermal conduction aid 27 over which the inner circumferential surface of the fixing belt 21 slides does not absorb the lubricant. Hence, the lubricant is the fluorine grease or the like that is retained on the nip-side face 27*a* of the thermal conduction aid 27, preventing the unit torque of the fixing device 20 from increasing over time.

However, the viscosity of the lubricant, for example, the fluorine grease, may change as the temperature of the fluorine grease changes. When the fixing device 20 starts at a low temperature, the unit torque of the fixing device 20 may increase, thus increasing a load imposed on the fixing device 20 and the image forming apparatus 1.

To address this circumstance, when the fixing device 20 according to this exemplary embodiment starts, the lateral end heaters 26*a* and 26*b* generate heat, the fixing belt 21 starts rotation, and then the halogen heaters 23A and 23B generate heat.

For example, when the fixing device 20 starts a fixing job, the power supply starts supplying power to the lateral end heaters 26*a* and 26*b*. When each of the temperature of the fixing belt 21 that is detected by the temperature detector 45*a* and the temperature of the fixing belt 21 that is detected by the temperature detector 45*b* reaches a predetermined temperature T1 in Celsius or higher, the fixing belt 21 starts rotating in the rotation direction D21. The predetermined temperature T1 defines a first temperature at which a starting torque of the fixing device 20 is a predetermined amount. The first temperature allows the fixing belt 21 to rotate in the rotation direction D21. Alternatively, when a thermometer disposed inside the image forming apparatus 1 determines or assumes that the temperature of the fixing belt 21 is the predetermined temperature T1 or higher, the fixing belt 21 starts rotating in the rotation direction D21. After the fixing belt 21 starts rotation, the power supply supplies power to the halogen heaters 23A and 23B. A series of operations described above of the lateral end heaters 26*a* and 26*b*, the fixing belt 21, and the halogen heaters 23A and 23B is performed due to reasons described below.

Since a heating span of the inner circumferential surface of the fixing belt 21 in a circumferential direction thereof, which is disposed opposite the halogen heaters 23A and 23B, is heated by the halogen heaters 23A and 23B directly, the heating span of the inner circumferential surface of the fixing belt 21 has a high temperature. Conversely, since a non-heating span of the inner circumferential surface of the fixing belt 21, which is not disposed opposite the halogen heaters 23A and 23B, is not heated by the halogen heaters 23A and 23B directly, the non-heating span of the inner circumferential surface of the fixing belt 21 has a low temperature lower than the high temperature of the heating span. Hence, the fixing belt 21 may suffer from variation in temperature in the circumferential direction and the axial direction of the fixing belt 21.

The variation in temperature of the fixing belt 21 may appear as various temperatures uneven in the circumferential direction of the fixing belt 21 (hereinafter referred to as uneven temperature of the fixing belt 21), which may not disappear even after the fixing belt 21 rotates idly for a while. For example, when the fixing device 20 starts while the fixing device 20 is cool at a low temperature, a substantial amount of heat is conducted from the fixing belt 21 to the pressure roller 22 having a thermal capacity greater than a thermal capacity of the fixing belt 21. Accordingly, even after the fixing belt 21 rotates idly for an extended period of time, uneven temperature of the fixing belt 21 is barely eliminated.

If the fixing belt 21 suffers from uneven temperature that is substantial, the fixing belt 21 may suffer from thermal expansion locally with variation in an amount of thermal expansion, which may warp the outer circumferential surface of the fixing belt 21. The warped outer circumferential surface of the fixing belt 21 may not form the fixing nip N precisely, resulting in formation of a toner image with degraded quality.

If warp of the outer circumferential surface of the fixing belt 21 exceeds yield stress, the fixing belt 21 may suffer from buckling failure (e.g., kink). If the fixing belt 21 kinks, the fixing belt 21 may form a faulty toner image on the sheet P and may be broken. The fixing device 20 configured to be warmed up or heated quickly is susceptible to those failures.

In order to prevent uneven temperature and buckling failure (e.g., kink) of the fixing belt 21, the power supply supplies power to the halogen heaters 23A and 23B after the fixing belt 21 starts rotation.

The series of operations for supplying power to the lateral end heaters 26*a* and 26*b*, rotating the fixing belt 21, supplying power to the halogen heaters 23A and 23B, which start in this order decrease the load imposed on the fixing device 20 and the image forming apparatus 1, attaining improved durability and an extended life of the fixing device 20 and the image forming apparatus 1.

Figure 12:
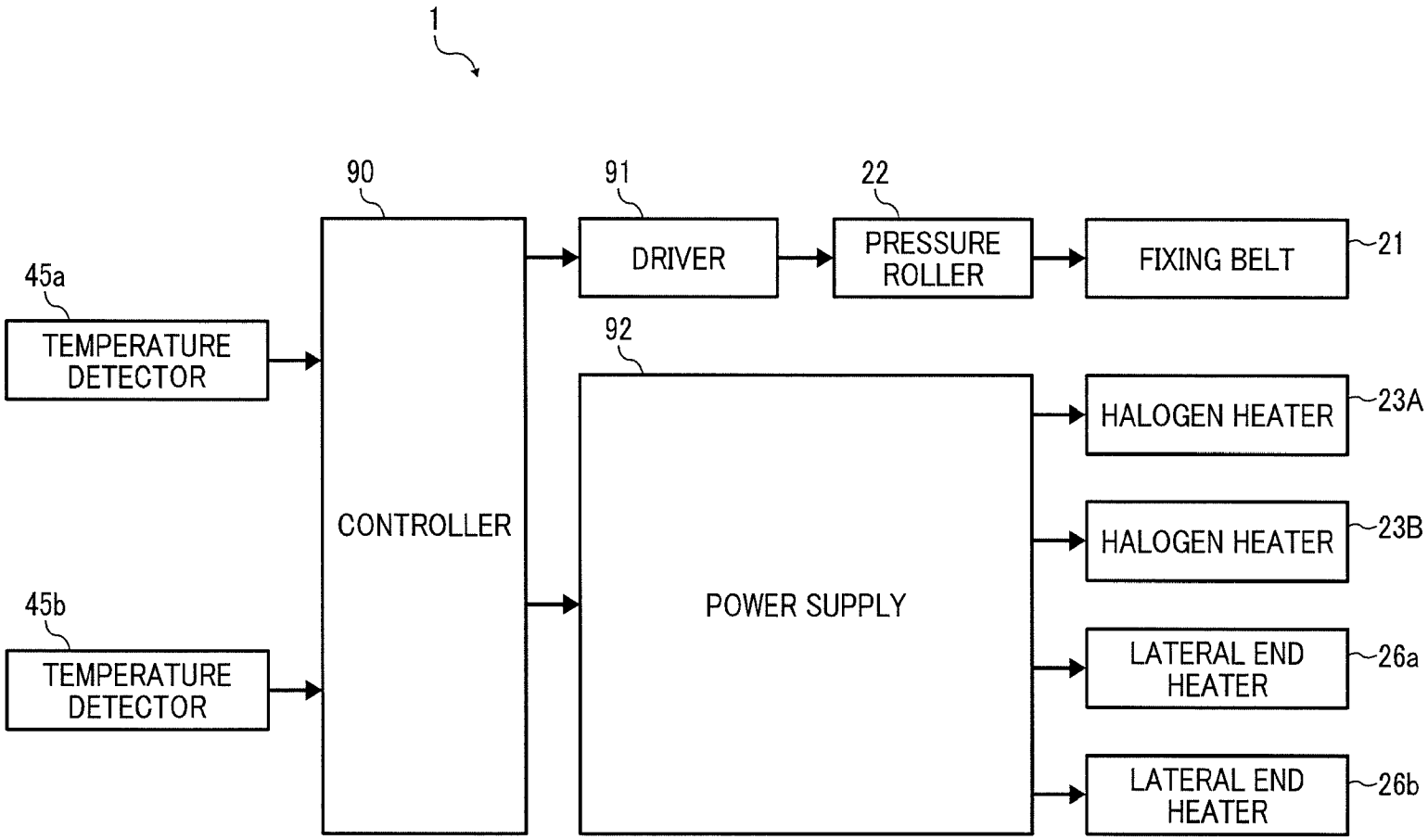
FIG. 12 is a block diagram of the fixing device depicted in FIG. 2.
Figure 13:
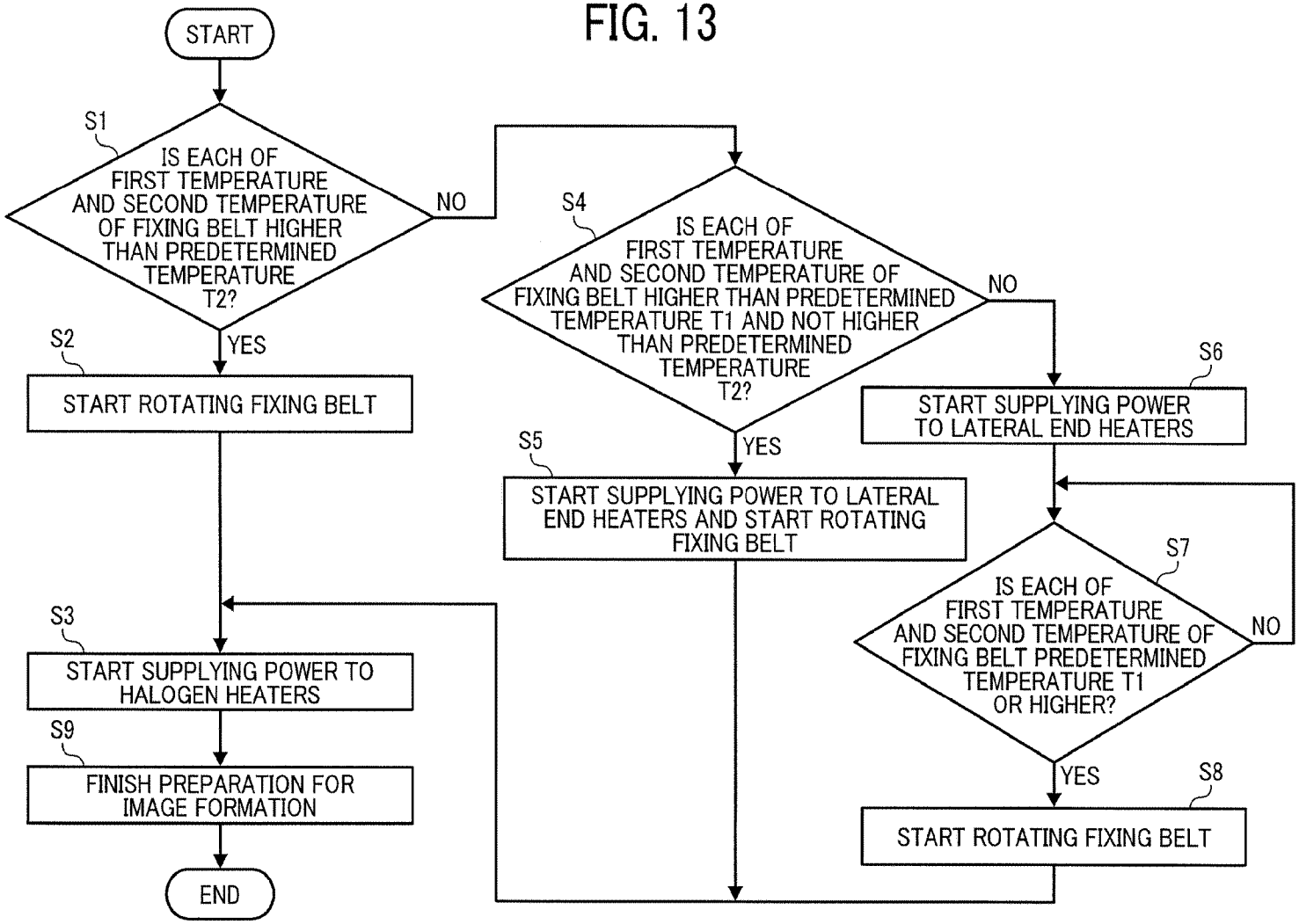
FIG. 13 is a flowchart illustrating a series of operations performed by the fixing device depicted in FIG. 2.

Referring to FIGS. 12 and 13, a description is provided of the series of operations, that is, a control method, performed by the fixing device 20 according to this exemplary embodiment.

FIG. 12 is a block diagram of the fixing device 20. FIG. 13 is a flowchart illustrating the series of operations performed by the fixing device 20. As illustrated in FIG. 12, the fixing device 20 or the image forming apparatus 1 includes a controller 90. For example, the controller 90 (e.g., a processor) includes a central processing unit (CPU), a random-access memory (RAM), and a read-only memory (ROM). The controller 90 may be disposed inside the fixing device 20 or the image forming apparatus 1.

In FIG. 13, a predetermined temperature T2 in Celsius defines a predetermined second temperature at which the starting torque of the fixing device 20 decreases sufficiently. The predetermined second temperature is higher than a predetermined first temperature (e.g., the predetermined temperature T1) and allows the fixing device 20 to start instantly.

As illustrated in FIG. 13, in step S1, the controller 90 determines whether or not each of a first temperature of the fixing belt 21 that is detected by the temperature detector 45*a* and a second temperature of the fixing belt 21 that is detected by the temperature detector 45*b* is higher than the predetermined temperature T2.

If the controller 90 determines that each of the first temperature of the fixing belt 21 that is detected by the temperature detector 45*a* and the second temperature of the fixing belt 21 that is detected by the temperature detector 45*b* is higher than the predetermined temperature T2 (YES in step S1), the starting torque of the fixing device 20 is small sufficiently. In step S2, the controller 90 starts rotating the fixing belt 21. For example, the controller 90 controls a driver 91 depicted in FIG. 12 to drive and rotate the pressure roller 22 which rotates the fixing belt 21 by friction between the pressure roller 22 and the fixing belt 21. A power supply 92 may not supply power to the lateral end heaters 26*a* and 26*b*. Alternatively, the driver 91 may be coupled to the fixing belt 21 to drive and rotate the fixing belt 21.

Conversely, if the controller 90 determines that at least one of the first temperature of the fixing belt 21 that is detected by the temperature detector 45*a* and the second temperature of the fixing belt 21 that is detected by the temperature detector 45*b* is the predetermined temperature T2 or lower (NO in step S1), the controller 90 proceeds to step S4.

In step S4, the controller 90 determines whether or not each of the first temperature of the fixing belt 21 that is detected by the temperature detector 45*a* and the second temperature of the fixing belt 21 that is detected by the temperature detector 45*b* is higher than the predetermined temperature T1 and not higher than the predetermined temperature T2.

When the fixing device 20 starts operation, due to a previous operation of the fixing device 20, a stand-by time after the previous operation, or the like, the first temperature of the fixing belt 21 that is detected by the temperature detector 45*a* and the second temperature of the fixing belt 21 that is detected by the temperature detector 45*b* may be different from each other or may change differently. If the controller 90 determines that each of the first temperature of the fixing belt 21 that is detected by the temperature detector 45*a* and the second temperature of the fixing belt 21 that is detected by the temperature detector 45*b* is higher than the predetermined temperature T1, the starting torque of the fixing device 20 is a predetermined value or smaller. In order to shorten the first print time, the controller 90 is requested to start supplying power to the lateral end heaters 26*a* and 26*b* and to start rotating the fixing belt 21 simultaneously. Accordingly, if the controller 90 determines that each of the first temperature of the fixing belt 21 that is detected by the temperature detector 45*a* and the second temperature of the fixing belt 21 that is detected by the temperature detector 45*b* is higher than the predetermined temperature T1 and not higher than the predetermined temperature T2 (YES in step S4), the controller 90 proceeds to step S5.

In step S5, the controller 90 starts supplying power to the lateral end heaters 26*a* and 26*b* so that the lateral end heaters 26*a* and 26*b* generate heat and starts rotating the fixing belt 21 simultaneously. For example, the controller 90 controls the power supply 92 to supply power to the lateral end heaters 26*a* and 26*b* and controls the driver 91 to drive and rotate the pressure roller 22 which rotates the fixing belt 21 by friction between the pressure roller 22 and the fixing belt 21.

Conversely, if the controller 90 determines that at least one of the first temperature of the fixing belt 21 that is detected by the temperature detector 45*a* and the second temperature of the fixing belt 21 that is detected by the temperature detector 45*b* is lower than the predetermined temperature T1 (NO in step S4), the controller 90 proceeds to step S6. In step S6, the controller 90 starts supplying power to the lateral end heaters 26*a* and 26*b* so that the lateral end heaters 26*a* and 26*b* generate heat. For example, the controller 90 controls the power supply 92 to supply power to the lateral end heaters 26*a* and 26*b*.

Subsequently, the controller 90 proceeds from step S6 to step S7. In step S7, the controller 90 determines whether or not each of the first temperature of the fixing belt 21 that is detected by the temperature detector 45*a* and the second temperature of the fixing belt 21 that is detected by the temperature detector 45*b* is the predetermined temperature T1 or higher. If the controller 90 determines that each of the first temperature of the fixing belt 21 that is detected by the temperature detector 45*a* and the second temperature of the fixing belt 21 that is detected by the temperature detector 45*b* is lower than the predetermined temperature T1 (NO in step S7), the controller 90 waits until each of the first temperature of the fixing belt 21 that is detected by the temperature detector 45*a* and the second temperature of the fixing belt 21 that is detected by the temperature detector 45*b* reaches the predetermined temperature T1 or higher.

If the controller 90 determines that each of the first temperature of the fixing belt 21 that is detected by the temperature detector 45*a* and the second temperature of the fixing belt 21 that is detected by the temperature detector 45*b* is the predetermined temperature T1 or higher (YES in step S7), the controller 90 proceeds to step S8. In step S8, the controller 90 starts rotating the fixing belt 21. For example, the controller 90 controls the driver 91 to drive and rotate the pressure roller 22 which rotates the fixing belt 21 by friction between the pressure roller 22 and the fixing belt 21.

As described above, if at least one of the first temperature of the fixing belt 21 that is detected by the temperature detector 45*a* and the second temperature of the fixing belt 21 that is detected by the temperature detector 45*b* is lower than the predetermined temperature T1, the lateral end heaters 26*a* and 26*b* heat the nip formation unit 200. When each of the first temperature of the fixing belt 21 that is detected by the temperature detector 45*a* and the second temperature of the fixing belt 21 that is detected by the temperature detector 45*b* reaches the predetermined temperature T1 or higher, the controller 90 starts rotating the fixing belt 21. Thus, a difference in the starting torque between one lateral end and another lateral end of the fixing belt 21 in the axial direction thereof is decreased.

Subsequently, the controller 90 proceeds to step S3. In step S3, the controller 90 starts supplying power to the halogen heaters 23A and 23B so that the halogen heaters 23A and 23B generate heat. For example, the controller 90 controls the power supply 92 to supply power to the halogen heaters 23A and 23B. Subsequently, the controller 90 proceeds to step S9. In step S9, the controller 90 finishes preparation for image formation that is performed by the fixing device 20. Thus, the image forming apparatus 1 starts image formation.

Figure 14:
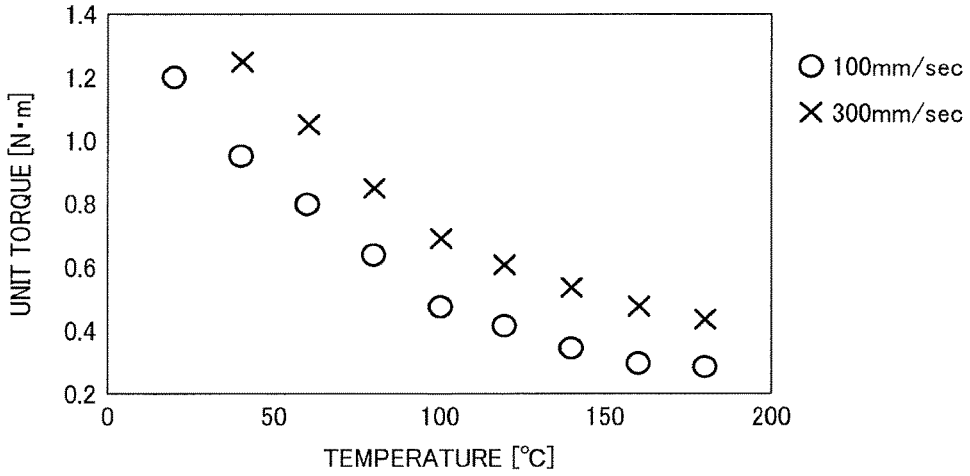
FIG. 14 is a graph illustrating a relation between a temperature at a position in proximity to a fixing nip and a unit torque of the fixing device depicted in FIG. 2.

FIG. 14 is a graph illustrating a relation between a temperature at a position in proximity to the fixing nip N and the unit torque of the fixing device 20. In FIG. 14, a vertical axis represents the unit torque in newton meter. A horizontal axis represents the temperature in Celsius at the position in proximity to the fixing nip N. Circular plots represent the unit torque at a rotation linear velocity of 100 mm/sec. X plots represent the unit torque at a rotation linear velocity of 300 mm/sec.

As illustrated in the graph in FIG. 14, even at an identical temperature at the position in proximity to the fixing nip N, the lower the rotation linear velocity is, the lower the unit torque is.

At the identical temperature at the position in proximity to the fixing nip N, as the rotation linear velocity decreases, the starting torque decreases advantageously. In order to shorten the first print time, the controller 90 starts rotating the fixing belt 21 earlier. If the fixing device 20 is configured to rotate the fixing belt 21 at a plurality of rotation linear velocities selectively, the controller 90 selects a lower rotation linear velocity at least until the halogen heaters 23A and 23B are turned on.

In this case, a time to switch from a lower rotation linear velocity to a higher rotation linear velocity synchronizes with a time to turn on the halogen heaters 23A and 23B. Alternatively, if variation in the temperature of the fixing belt 21 in the axial direction and the circumferential direction thereof is within a temperature deviation that prevents uneven temperature and buckling failure (e.g., kink) of the fixing belt 21 described above, the time to switch from the lower rotation linear velocity to the higher rotation linear velocity may not synchronize with the time to turn on the halogen heaters 23A and 23B. Hence, the time to switch from the lower rotation linear velocity to the higher rotation linear velocity is determined to be a condition advantageous to heat the fixing belt 21.

As described above, with the fixing device 20 according to this exemplary embodiment, the lateral end heaters 26*a* and 26*b* generate heat, the fixing belt 21 starts rotation, and then the halogen heaters 23A and 23B generate heat, preventing uneven temperature and buckling failure of the fixing belt 21 and decreasing the starting torque.

Additionally, when each of the first temperature of the fixing belt 21 that is detected by the temperature detector 45*a* and the second temperature of the fixing belt 21 that is detected by the temperature detector 45*b* reaches the predetermined temperature T1, the controller 90 starts rotating the fixing belt 21. Accordingly, the temperature of the fixing belt 21 that reaches the predetermined temperature T1 at which the starting torque decreases triggers rotation of the fixing belt 21.

The fixing device 20 rotates the fixing belt 21 at the plurality of rotation linear velocities selectively. The fixing belt 21 rotates at the lower rotation linear velocity at least until the halogen heaters 23A and 23B generate heat, thus decreasing the starting torque and shortening the first print time.

A description is provided of variation of the control method performed by the fixing device 20.

Instead of the temperature detectors 45*a* and 45*b*, the temperature sensor 29 disposed opposite the outer circumferential surface of the fixing belt 21 as illustrated in FIG. 2 may detect the temperature of the fixing belt 21. Alternatively, a temperature sensor disposed inside the image forming apparatus 1 may estimate the temperature of the fixing belt 21. The control method illustrated in FIG. 13 may also be performed with the temperature sensor 29 or the temperature sensor disposed inside the image forming apparatus 1 with proper modification.

A description is provided of advantages of the fixing device 20.

As illustrated in FIG. 2, a fixing device (e.g., the fixing device 20) includes an endless belt (e.g., the fixing belt 21) that is flexible, formed into a loop, and rotatable in a rotation direction (e.g., the rotation direction D21). A pressure rotator (e.g., the pressure roller 22) is disposed opposite an outer circumferential surface of the endless belt. A radiant heater (e.g., the halogen heaters 23A and 23B) is disposed opposite an inner circumferential surface of the endless belt to heat the endless belt. A nip formation pad (e.g., the nip formation pad 24) is disposed opposite the inner circumferential surface of the endless belt. As the pressure rotator is pressed against the nip formation pad via the endless belt, the nip formation pad forms a fixing nip (e.g., the fixing nip N) between the endless belt and the pressure rotator.

As illustrated in FIG. 3, a contact heater (e.g., the lateral end heaters 26*a* and 26*b*) is disposed at least at one lateral end of the nip formation pad in a longitudinal direction thereof. The contact heater heats at least one lateral end of the endless belt in an axial direction thereof. The nip formation pad includes a nip-side face (e.g., the nip-side face 24*c*) disposed opposite the endless belt. The contact heater includes a nip-side face (e.g., the nip-side face 26*c*) disposed opposite the endless belt. A thermal conduction aid (e.g., the thermal conduction aid 27) covers the nip-side face of the nip formation pad and the nip-side face of the contact heater. The thermal conduction aid conducts heat applied to the endless belt in the axial direction of the endless belt. The inner circumferential surface of the endless belt is applied with a lubricant.

As illustrated in FIG. 13, a controller (e.g., the controller 90 depicted in FIG. 12) controls the contact heater to generate heat, controls the endless belt to rotate, and controls the radiant heater to generate heat sequentially.

The contact heater is disposed at least at one lateral end of the nip formation pad in the longitudinal direction thereof. The contact heater heats at least one lateral end of the endless belt in the axial direction thereof. Accordingly, the contact heater heats recording media of special sizes (e.g., an A3 extension size sheet), improving quality of a toner image formed on the recording media and reliability of the fixing device. Additionally, the controller controls the contact heater to generate heat, controls the endless belt to rotate, and controls the radiant heater to generate heat so that the contact heater starts generating heat, the endless belt starts rotating, and then the radiant heater starts generating heat sequentially, thus decreasing a starting torque of the endless belt even at a low temperature.

As illustrated in FIG. 5, the fixing device 20 employs a center conveyance system in which the sheet P is centered on the fixing belt 21 in the axial direction thereof. Alternatively, the fixing device 20 may employ a lateral end conveyance system in which the sheet P is conveyed in the sheet conveyance direction DP along one lateral end of the fixing belt 21 in the axial direction thereof. In this case, one of the heat generators 40B of the halogen heater 23B and one of the lateral end heaters 26*a* and 26*b* are eliminated. Another one of the heat generators 40B of the halogen heater 23B and another one of the lateral end heaters 26*a* and 26*b* are distal from the one lateral end of the fixing belt 21 in the axial direction thereof.

According to the exemplary embodiments described above, the fixing belt 21 serves as an endless belt. Alternatively, a fixing film, a fixing sleeve, or the like may be used as an endless belt. Further, the pressure roller 22 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

an endless belt that is flexible and rotatable, the endless belt being applied with a lubricant on an inner circumferential surface of the endless belt;

a nip formation pad disposed opposite the inner circumferential surface of the endless belt;

a pressure rotator to press against the nip formation pad via the endless belt to form a fixing nip between the endless belt and the pressure rotator;

a radiant heater, disposed opposite the inner circumferential surface of the endless belt, to beat the endless belt;

at least one contact heater, disposed at least at one lateral end of the nip formation pad in a longitudinal direction of the nip formation pad, to heat at least one lateral end of the endless belt in an axial direction of the endless belt;

at least one temperature detector, disposed opposite the endless belt, to detect a temperature of the endless belt; and a controller to control the at least one contact heater to generate heat, control the endless belt to rotate, and control the radiant heater to generate heat sequentially based on the temperature of the endless belt that is detected by the at least one temperature detector.

2. The fixing device according to claim 1, further comprising a thermal conduction aid to conduct heat applied to the endless belt in the axial direction of the endless belt, wherein each of the nip formation pad and the at least one contact heater includes a nip-side face disposed opposite the endless belt, and wherein the thermal conduction aid covers the nip-side face of each of the nip formation pad and the at least one contact heater.

3. The fixing device according to claim 1, wherein the controller rotates the endless belt when the at least one temperature detector detects a predetermined first temperature.

4. The fixing device according to claim 3, wherein the controller controls the at least one contact heater to generate heat and controls the endless belt to rotate when the temperature of the endless belt that is detected by the at least one temperature detector is higher than the predetermined first temperature and not higher than a predetermined second temperature being higher than the predetermined first temperature, the predetermined second temperature to decrease a starting torque of the endless belt.

5. The fixing device according to claim 3, wherein the controller controls the endless belt to rotate and controls the radiant heater to generate heat when the temperature of the endless belt that is detected by the at least one temperature detector is higher than a predetermined second temperature being higher than the predetermined first temperature, the predetermined second temperature to decrease a starting torque of the endless belt.

6. The fixing device according to claim 3, wherein the at least one contact heater includes:

a first contact heater disposed opposite one lateral end of the endless belt in the axial direction of the endless belt; and a second contact heater disposed opposite another lateral end of the endless belt in the axial direction of the endless belt, and wherein the at least one temperature detector includes:

a first temperature detector, disposed opposite the one lateral end of the endless belt, to detect a temperature of the one lateral end of the endless belt that is heated by the first contact heater; and a second temperature detector, disposed opposite the another lateral end of the endless belt, to detect a temperature of the another lateral end of the endless belt that is heated by the second contact heater.

7. The fixing device according to claim 6, wherein the controller controls the endless belt to rotate when each of the temperature of the one lateral end of the endless belt that is detected by the first temperature detector and the temperature of the another lateral end of the endless belt that is detected by the second temperature detector is the predetermined first temperature.

8. The fixing device according to claim 7, wherein the controller controls the first contact heater and the second contact heater to generate heat and controls the endless belt to rotate when each of the temperature of the one lateral end of the endless belt that is detected by the first temperature detector and the temperature of the another lateral end of the endless belt that is detected by the second temperature detector is higher than the predetermined first temperature and not higher than a predetermined second temperature being higher than the predetermined first temperature, the predetermined second temperature to decrease a starting torque of the endless belt.

9. The fixing device according to claim 7, wherein the controller controls the endless belt to rotate and controls the radiant heater to generate heat when each of the temperature of the one lateral end of the endless belt that is detected by the first temperature detector and the temperature of the another lateral end of the endless belt that is detected by the second temperature detector is higher than a predetermined second temperature being higher than the predetermined first temperature, the predetermined second temperature to decrease a starting torque of the endless belt.

10. The fixing device according to claim 1, wherein the controller controls the endless belt to rotate at a plurality of rotation linear velocities selectively, and wherein the controller controls the endless belt to rotate at a lower rotation linear velocity of the plurality of rotation linear velocities at least until the radiant heater generates heat.

11. The fixing device according to claim 1, wherein the radiant heater includes:

a first heat generator to generate heat; and a second heat generator, disposed outboard from the first heat generator in the axial direction of the endless belt, to generate heat, and wherein the at least one contact heater partially overlaps the second heat generator in the axial direction of the endless belt.

12. The fixing device according to claim 11, further comprising:

a first combined heat generator defined by the first heat generator and the second heat generator; and a second combined heat generator defined by the first heat generator, the second heat generator, and the at least one contact heater, wherein the at least one temperature detector is disposed outboard from the first combined heat generator and inboard from a lateral edge of the second combined heat generator in the axial direction of the endless belt.

13. The fixing device according to claim 12, wherein the first combined heat generator corresponds to a width of an A3 size sheet in portrait orientation.

14. The fixing device according to claim 12, wherein the second combined heat generator corresponds to a width of one of an A3 extension size sheet and a 13-inch sheet.

15. An image forming apparatus comprising:

an image forming device to form a toner image; and a fixing device disposed downstream from the image forming device in a recording medium conveyance direction to fix the toner image on a recording medium, the fixing device including:

an endless belt that is flexible and rotatable, the endless belt being applied with a lubricant on an inner circumferential surface of the endless belt;

a nip formation pad disposed opposite the inner circumferential surface of the endless belt;

a pressure rotator to press against the nip formation pad via the endless belt to form a fixing nip between the endless belt and the pressure rotator;

a radiant heater, disposed opposite the inner circumferential surface of the endless belt, to heat the endless belt;

at least one contact heater, disposed at least at one lateral end of the nip formation pad in a longitudinal direction of the nip formation pad, to heat at least one lateral end of the endless belt in an axial direction of the endless belt;

at least one temperature detector, disposed opposite the endless belt, to detect a temperature of the endless belt; and a controller to control the at least one contact heater to generate heat, control the endless belt to rotate, and control the radiant heater to generate heat sequentially based on the temperature of the endless belt that is detected by the at least one temperature detector.

16. An image forming method comprising:

determining that a temperature of an endless belt, which is detected by at least one temperature detector disposed opposite the endless belt, is higher than a predetermined first temperature and not higher than a predetermined second temperature, the endless belt being flexible, rotatable, and applied with a lubricant on an inner circumferential surface of the endless belt;

supplying power to at least one contact heater to heat the endless belt, the at least one contact heater being disposed at least at one lateral end of a nip formation pad in a longitudinal direction of the nip formation pad, the nip formation pad being disposed opposite the inner circumferential surface of the endless belt;

rotating the endless belt;

supplying power to a radiant heater to heat the endless belt, the radiant heater being disposed opposite the inner circumferential surface of the endless belt; and controlling, with a controller, the supplying power to the at least one contact heater to heat the endless belt, the rotating the endless belt, and the supplying power to the radiant heater to heat the endless belt sequentially based on the temperature of the endless belt that is detected by the at least one temperature detector.

* * * * *